US010295958B2

(12) United States Patent
Sakai et al.

(10) Patent No.: US 10,295,958 B2
(45) Date of Patent: May 21, 2019

(54) PACKING MEMBER

(71) Applicant: CANON KABUSHIKI KAISHA, Tokyo (JP)

(72) Inventors: Kengo Sakai, Yokohama (JP); Yoshimasa Komaki, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/515,091

(22) PCT Filed: Sep. 16, 2015

(86) PCT No.: PCT/JP2015/004727
§ 371 (c)(1),
(2) Date: Mar. 28, 2017

(87) PCT Pub. No.: WO2016/051702
PCT Pub. Date: Apr. 7, 2016

(65) Prior Publication Data

US 2017/0242392 A1 Aug. 24, 2017

(30) Foreign Application Priority Data

Sep. 30, 2014 (JP) ..... 2014-201849

(51) Int. Cl.
*B65D 81/05* (2006.01)
*G03G 21/18* (2006.01)

(52) U.S. Cl.
CPC ..... *G03G 21/181* (2013.01); *B65D 81/05* (2013.01)

(58) Field of Classification Search
CPC ..... B65D 81/05; B65D 43/162; G03G 21/181
USPC ..... 399/111
See application file for complete search history.

(56) References Cited

U.S. PATENT DOCUMENTS

| | | | | |
|---|---|---|---|---|
| 3,710,975 | A | 1/1973 | Jansen | |
| 2005/0035118 | A1* | 2/2005 | Garg | B65D 43/162 220/4.23 |
| 2012/0111858 | A1* | 5/2012 | Lewis | B65D 43/162 220/4.23 |

FOREIGN PATENT DOCUMENTS

| | | | |
|---|---|---|---|
| EP | 1814115 | A2 | 8/2007 |
| EP | 2713224 | A2 | 4/2014 |
| JP | 2002-193341 | A | 7/2002 |
| JP | 3639834 | B2 | 4/2005 |
| JP | 2014-13386 | A | 1/2014 |
| JP | 2014-048468 | A | 3/2014 |

* cited by examiner

*Primary Examiner* — Catherine A. Simone
(74) *Attorney, Agent, or Firm* — Canon U.S.A., Inc. IP Division

(57) ABSTRACT

A packing member includes a first recessed portion, a second recessed portion, a first flange connected to the first recessed portion at a first end, and a second flange connected to the second recessed portion at a first end. The first flange includes at least one first bent portion protruding in a direction intersecting a joined surface at which part of the first flange and part of the second flange are joined. When at least one of a second end of the first flange and a second end of the second flange is in contact with a surface other than the packing member, the second end of the first flange and the second end of the second flange can be moved along the surface.

18 Claims, 19 Drawing Sheets

PACKING MEMBER

TECHNICAL FIELD

The present invention relates to a packing member for a cartridge that can be attached to and detached from an image forming apparatus.

Examples of the image forming apparatus include electrophotographic copying machines, electrophotographic printers (for example, laser beam printers and light-emitting diode (LED) printers), facsimile machines, and word processors. Examples of the cartridge include a cartridge including an electrophotographic photosensitive member serving as an image bearing member and a cartridge in which an electrophotographic photosensitive member and a developing unit that acts on the electrophotographic, photosensitive member are combined and which can he attached to and detached from an image forming apparatus.

The packing member is a member for protecting a cartridge from an external vibration and impact during transportation.

BACKGROUND ART

An electrophotographic image forming apparatus using an electrophotographic process, such as a printer, (hereinafter referred to as an image forming apparatus) forms a latent image by uniformly charging an electrophotographic, photosensitive member serving as an image bearing member and selectively exposing the electrophotographic photosensitive member with light. The latent image is developed with a developer to appear as a developed image. The developed image is then transferred onto a recording medium.

The transferred developed image is subjected to heat or pressure so that it is fixed on the recording medium to form an image, Such image forming apparatuses in the related art involve replenishing developer and maintaining various processing units.

To facilitate the work of replenishing developer and maintenance, part or all of an electrophotographic photosensitive member, a charging unit, a developing unit, and a cleaning unit are disposed in a frame into a cartridge. To allow this process cartridge (hereinafter referred to as a cartridge) to be attached to and detached from an image forming apparatus, a process cartridge system has been employed.

This process cartridge system allows the user to perform maintenance of the apparatus by replacing the cartridge, thus remarkably improving the operability. Such a configuration in which the cartridge can be detachable so that the user can replace the cartridge allows the user to extract the cartridge from the image forming apparatus and to replace it with a new cartridge as a common system.

Shipped new cartridges are each packed in a packing member for protecting the cartridge from vibration and impact during transportation. When installing a new cartridge into an image forming apparatus main body, the user unpacks the packing member, takes the cartridge out of the packing member, and installs the cartridge into the image forming apparatus main body.

Various examples of the packing member that packs a cartridge to protect it from vibration and impact during transportation are disclosed (PTL 1 and PTL 2).

PTL 1 discloses a packing member which is made of a vacuum-formed resin sheet and covers the whole of a cartridge. This packing member has many protrusions and depressions on the surface thereof, with which a cartridge is supported. The packing member fixes the cartridge with flanges of the packing member joined by thermal fusion or the like.

CITATION LIST

Patent Literature

PTL 1: Japanese Patent Laid-Open No. 2014-13386
PTL 2: Japanese Patent No. 3639834

SUMMARY OF INVENTION

Technical Problem

With a configuration in which a cartridge is accommodated in two recessed members, and flanges of the recessed members are joined together to fix the cartridge in the packing member, these flanges can be given an impact during transportation or the like. When the flanges are given an impact, the cushioning performance of the flanges, which is exhibited when the flanges are curved or deformed, can vary, resulting in insufficient cushioning performance. If the flanges are not curved but stand erect, the impact is transmitted to a cartridge to be packed through the flanges, so that damage to the cartridge cannot be sufficiently prevented.

Solution to Problem

A packing member according to a first aspect of the present invention includes a first recessed portion, a second recessed portion, a first flange connected to the first recessed portion at a first end, and a second flange connected to the second recessed portion at a first end. Part of the first flange and part of the second flange are joined to form a joined surface to allow a cartridge that can be attached to and detached from an image forming apparatus to be accommodated between the first recessed portion and the second recessed portion. The first flange includes at least one first bent portion protruding in a direction intersecting the joined surface. When at least one of a second end of the first flange and a second end of the second flange is in contact with a surface other than the packing member, the second end of the first flange and the second end of the second flange can be moved along the surface.

A packing member according to a second aspect of the present invention includes a first recessed portion, a second recessed portion, a first flange connected to the first recessed portion at a first end, and a second flange connected to the second recessed portion at a first end. Part of the first flange and part of the second flange are joined to form a joined surface to allow a cartridge that can be attached to and detached from an image forming apparatus to be accommodated between the first recessed portion and the second recessed portion. The first recessed portion includes a first force receiving portion at a position separate from the joined surface in a direction perpendicular to the joined surface. The first force receiving portion receives a load from the cartridge. When at least one of a second end of the first flange and a second end of the second flange is in contact with a surface other than the packing member, the second end of the first flange and the second end of the second flange can be moved along the surface.

Further features of the present invention will become apparent from the following description of exemplary embodiments with reference to the attached drawings.

DESCRIPTION OF EMBODIMENTS

Reference Example

A reference example of a cartridge to be packed according to an embodiment of the present invention will be described with reference to FIGS. 3 to 8.

The reference example shows a full-color image forming apparatus, to and from which four cartridges can be attached and detached, as an image forming apparatus using a cartridge to be packed. It is noted that this is given for mere illustration and is not intended to limit the present invention, as any apparatus may be employed as appropriate when needed. One example is a monochrome image forming apparatus to and from which one cartridge can be attached and detached. The following reference example shows a printer as one form of an image forming apparatus in which a cartridge, or a packed object, is employed. However, this is given for illustrative purpose only. The present invention can also be applied to other image forming apparatuses, such as copying machines and facsimile machines, or multifunctional peripherals in which these functions are combined.

Schematic Configuration of Image Forming Apparatus

Figure 3:
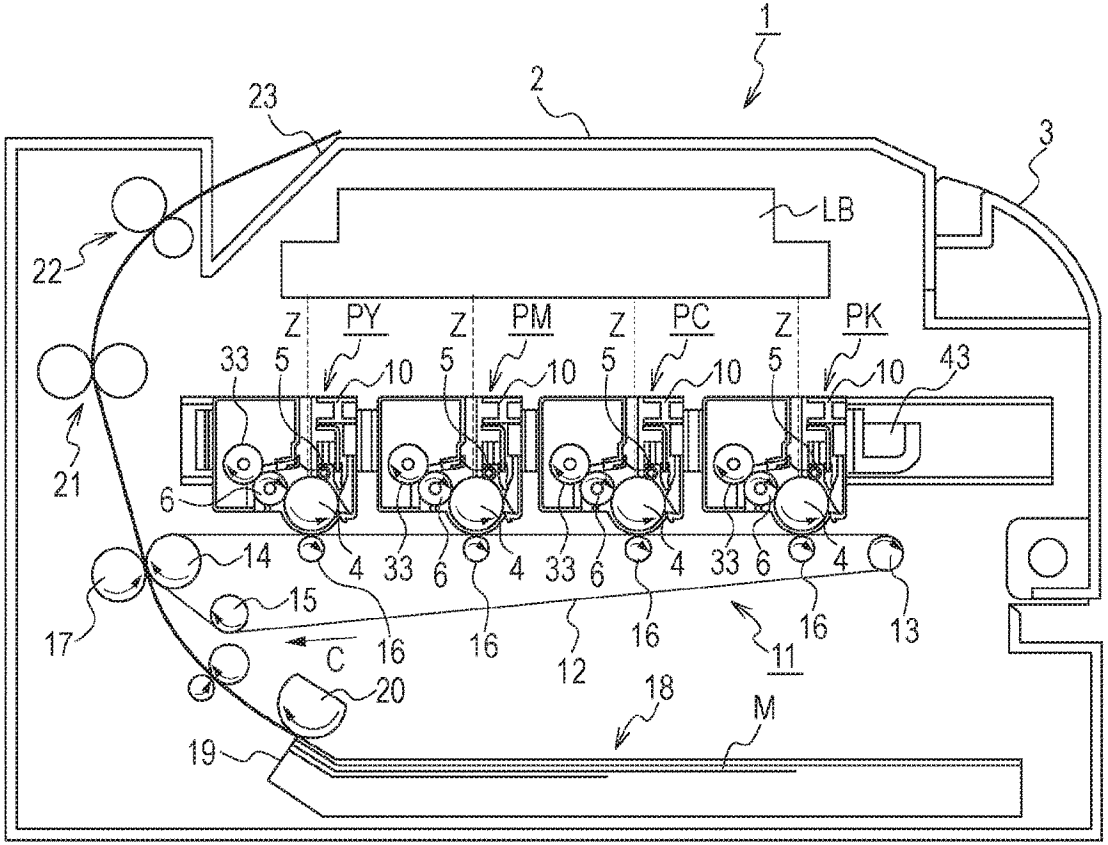
FIG. 3 is a schematic cross-sectional view of an image forming apparatus according to a reference example.

FIG. 3 is a schematic cross-sectional view of an image forming apparatus 1 of this; reference example.

As shown in FIG. 3, the image forming apparatus 1 is a four full color laser printer using an electrophotographic process, which forms a color image on a recording medium M. The image forming apparatus 1 employs a process cartridge system, in which a cartridge is detachably installed in an apparatus main body 2 and forms a color image on the recording medium M. For the image forming apparatus 1, a door 3 side is a front (a front surface), and a surface opposite to the front is a back (a rear surface). The right of the image forming apparatus 1 viewed from the front is referred to as a driving side, and the left is referred to as a non-driving side.

The apparatus main body 2 accommodates four cartridges P-a first cartridge PY, a second cartridge PM, a third cartridge PC, and fourth cartridge PK-in a horizontal direction. The first to fourth cartridges P have the same electrophotographic processing mechanism and contain developers of different colors (hereinafter referred to as toners). The first to fourth cartridges P receive a rotational driving force transmitted from a drive output unit (not shown) of the apparatus main body 2. The first to fourth cartridges P are supplied with a bias voltage (for example, a charging bias or a developing bias) from the apparatus main body 2 (not shown).

Figure 4:
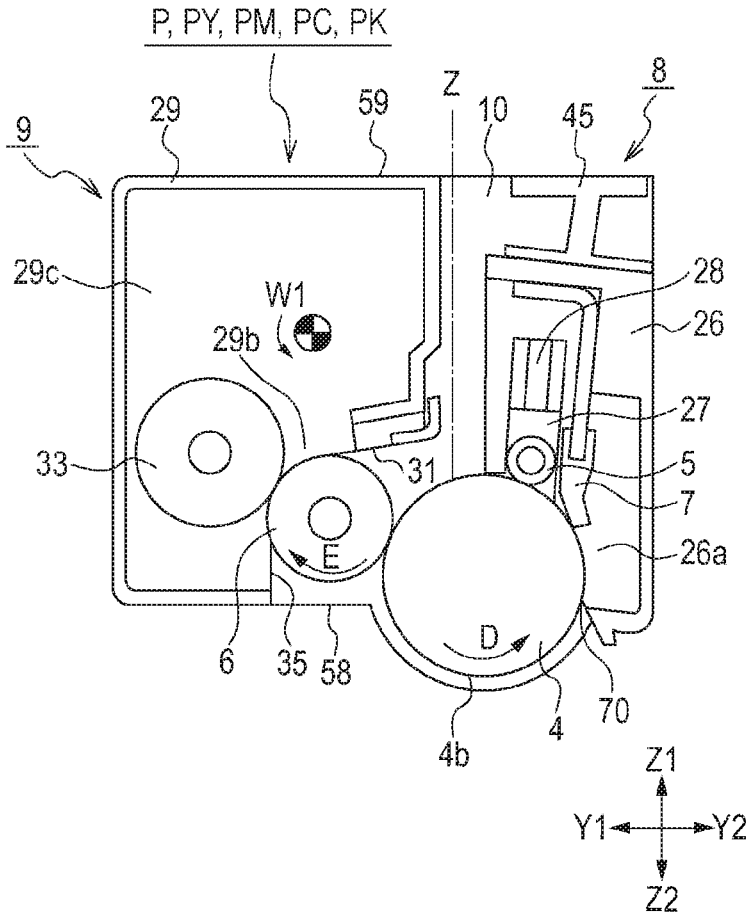
FIG. 4 is a schematic cross-sectional view of a cartridge according to a reference example.

As shown in FIG. 4, the first to fourth cartridges P of this reference example each include a first framework including an electrophotographic photosensitive member 4 (hereinafter referred to as a photosensitive drum), a charging unit, and a cleaning unit, which serve as processing units for the photosensitive drums 4. The first framework is also referred to as a cleaning unit 8.

The first to fourth cartridges P each further include a developing unit 9, or a second framework, including a developing device for developing an electrostatic image on the photosensitive drum 4.

The cleaning unit 8 and the developing unit 9 are combined together. In this reference example, the charging unit is a charging roller 5, the cleaning unit is a cleaning blade 7, and the developing unit is a developer bearing member 6 (hereinafter referred to as a developing roller). A more specific configuration of the cartridge will be described later.

The first cartridge PY accommodates a yellow (Y) toner in a developing framework 29 and forms a yellow toner image on the surface of the photosensitive drum 4. The second cartridge PM accommodates a magenta (M) toner in the developing framework 29 and forms a magenta toner image on the surface of the photosensitive drum 4. The third cartridge PC accommodates a cyan (C) toner in the developing framework 29 and forms a cyan toner image on the surface of the photosensitive drum 4. The fourth cartridge PK accommodates a black (K) toner in the developing framework 29 and forms a black toner image on the surface of the photosensitive drum 4.

As shown in FIG. 3, a laser scanner unit LB serving as an exposure unit is disposed above the first to fourth cartridges P. The laser scanner unit LB emits a laser beam Z in accordance with image information. The laser beam Z passes through exposure windows 10 of the cartridges P to scan the surfaces of the photosensitive drums 4, thus performing exposure.

An intermediate transfer belt unit 11 serving as a transfer member is disposed below the first to fourth cartridges P. The intermediate transfer belt unit 11 includes a driving roller 13, a turn roller 14, and a tension roller 15, across which a flexible transfer belt 12 is stretched. The lower surfaces of the photosensitive drums 4 of the first to fourth cartridges P are in contact with the upper surface of the transfer belt 12. The points of contact therebetween are primary transfer portions. Primary transfer rollers 16 opposed to the photosensitive drums 4 are disposed inside the transfer belt 12.

The turn roller 14 is in contact with a secondary transfer roller 17, with the transfer belt 12 therebetween. The point of contact between the transfer belt 12 and the secondary transfer roller 17 is a secondary transfer portion. A feed unit 18 is disposed below the intermediate transfer belt unit 11. The feed unit 18 includes a paper feed tray 19 in which the recording media M are stacked and a paper feed roller 20. The apparatus main body 2 accommodates a fixing unit 21 and a discharge unit 22 at the upper left in FIG. 3. The top of the apparatus main body 2 serves as a paper output tray 23. The recording medium M on which a toner image is fixed by a fixing device of the fixing unit 21 is ejected to the paper output tray 23.

Image Forming Operation

An operation for forming a full-color image is as follows.

The photosensitive drums 4 of the first to fourth cartridges P are rotationally driven at a predetermined speed (in the direction of arrow D in FIG. 4, counterclockwise in FIG. 3). The transfer belt 12 is rotationally driven at the points of contact with the photosensitive drums 4 in the same direction as that of the rotation of the photosensitive drums 4 (the direction of arrow C in FIG. 3) at a speed corresponding to the speed of the photosensitive drums 4. The laser scanner unit LB is also driven. In each cartridge P, the charging roller 5 charges the surface of the photosensitive drum 4 to a predetermined polarity and potential in synchronization with the driving of the laser scanner unit LB. The surface of the photosensitive drum 4 is scanned with a laser beam Z in response to a signal. Thus, an electrostatic image responsive to an image signal for a corresponding color is formed on the surface of the photosensitive drum 4. The formed electrostatic image is developed using the developing roller 6, which is rotationally driven at a predetermined speed (in the direction of arrow E in FIG. 4, and clockwise in FIG. 3).

Such an electrophotographic image forming operation causes a toner image corresponding to a yellow component of the full-color image to be formed on the photosensitive drum 4 of the first cartridge PY. This toner image is primarily transferred onto the transfer belt 12. Likewise, a magenta toner image corresponding to a magenta component of the full-color image is formed on the photosensitive drum 4 of the second cartridge PM. The toner image is superposed, or primarily transferred, on the yellow toner image that has already been transferred to the transfer belt 12. Likewise, a cyan toner image corresponding to a cyan component of the full-color image is formed on the photosensitive drum 4 of the third cartridge PC. The toner image is superposed, or primarily transferred, on the yellow and magenta toner image that has already been transferred to the transfer belt 12. Likewise, a black toner image corresponding to a black component of the full-color image is formed on the photosensitive drum 4 of the fourth cartridge PK. The toner image is superposed, or primarily transferred, on the yellow, magenta, and cyan toner image that has already been transferred to the transfer belt 12. Thus, a full-four-color unfixed toner image of yellow, magenta, cyan, and black colors is formed on the transfer belt 12.

The recording media M are separated one by one aa predetermined controlled timing. The recording media M are fed to the secondary transfer portion, which is the point of contact between the secondary transfer roller 17 and the transfer belt 12, at the predetermined controlled timing. Thus, the four-color superposed toner image on the transfer belt 12 is transferred to the surfaces of the recording media M in sequence in the process in which the recording media M are conveyed to the secondary transfer portion.

Configuration of Cartridge

Figure 5A:
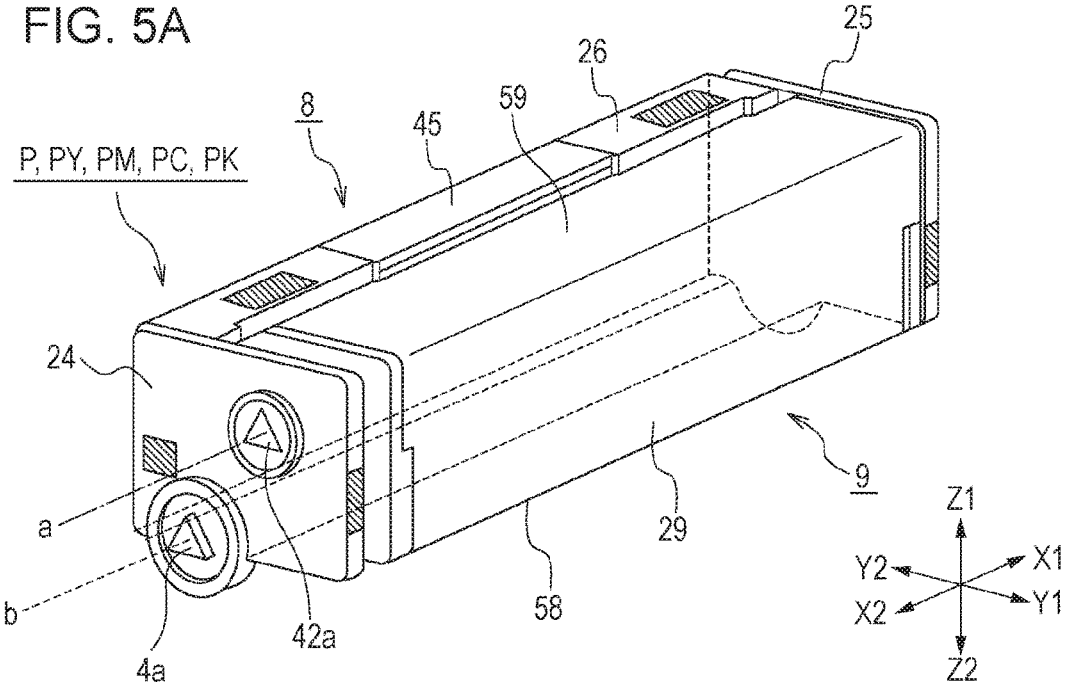
FIG. 5A is a perspective view of the cartridge according to the reference example, viewed from a driving side.
Figure 5B:
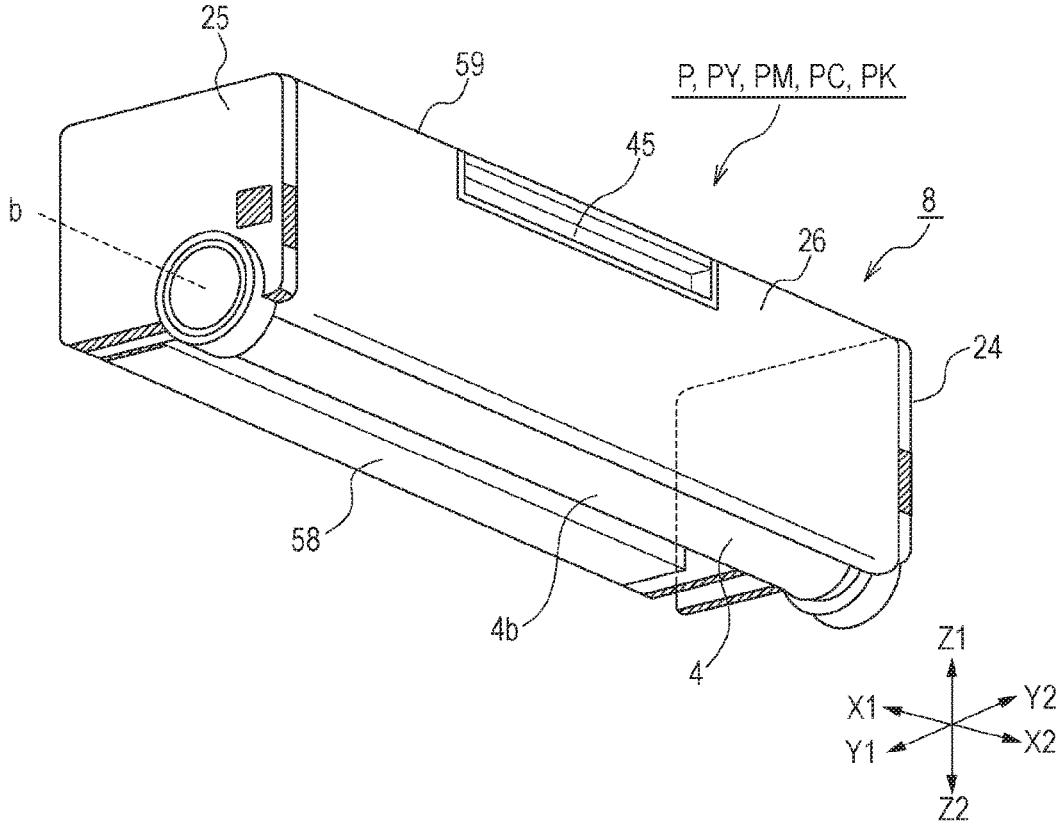
FIG. 5B is a perspective view of the cartridge viewed from a non-driving side.

FIGS. 5A and 5B are perspective views of the cartridge P to be packed, viewed from different angles.

FIG. 5A is a perspective view of the cartridge P viewed from the driving side. FIG. 5B is a perspective view of the cartridge P viewed from the non-driving side. The cartridge P is a substantially rectangular parallelepiped that is long in the direction of the rotation axis b (indicated by a broken line in an X-direction) of the photosensitive drum 4 and includes the cleaning unit 8, the developing unit 9, a driving-side cover 24, and a non-driving-side cover 25. The cartridge P has a two-frame structure in which the driving-side cover 24 and the non-driving-side cover 25 fixed to the cleaning unit 8 rotationally support the developing unit 9 about the center of rotation (a one-dot chain line a in FIG. 5A) of the developing unit 9. The developing unit 9 is urged in a fixed direction (the direction of arrow W1 in FIG. 4) with a spring or the like (not shown), which will be described below.

As shown in FIG. 4, the cleaning unit (drum unit) 8 includes the photosensitive drum 4, the charging roller 5, a cleaning container 26 including the cleaning blade 7, and a holding portion 45. As shown in FIGS. 5A and 5B, the photosensitive drum 4 is rotatably supported by the driving-side cover 24 and the non-driving-side cover 25 and is rotationally driven by the driving force of a motor (not shown) of the apparatus main body 2 through a drum-driving coupling 4*a* (in the direction of arrow D in FIG. 4). As shown in FIG. 4, the charging roller 5 is rotatably supported at both ends by a charging-roller shaft bearing 27 in the cleaning container 26. The charging roller 5 is in contact with the surface of the photosensitive drum 4 to rotate with the rotation thereof and charges the surface of the photosensitive drum 4 with a charging bias supplied thereto. Both ends of the charging roller 5 are pressed against the surface of the photosensitive drum 4 by a charging-roller pressing spring 28 to uniformly charge the surface. The cleaning blade 7 is fixed to the cleaning container 26 in such a manner that an elastic rubber portion at an end is in contact with the photosensitive drum 4 in the direction counter to the rotating direction (the direction of arrow D in FIG. 4). In forming an image, the cleaning blade 7 scrapes a toner remaining after transfer on the photo-sensitive drum 4 to clean the surface of the photosensitive drum 4. To scrape the remaining toner, the end of the cleaning blade 7 is in pressure-contact with the surface of the photosensitive drum 4. The remaining toner scraped off the surface of the photo-sensitive drum 4 by the cleaning blade 7 is put as a waste toner into a waste toner container 26*a* in the cleaning container 26. For this purpose, the cleaning container 26 includes a waste-toner recovery sheet 70 for preventing the waste toner from leaking through the clearance between the photosensitive drum 4 and the cleaning blade 7, fixed in the longitudinal direction of the photosensitive drum 4. Furthermore, cleaning-blade-end sealing members (not shown) are provided at both ends of the cleaning blade 7 in the longitudinal direction.

The holding portion 45 is a portion for a user to hold the cartridge P and is attached to the cleaning container 26 integrally or separately. The holding portion 45 may be disposed on the developing framework 29.

In this reference example, the cartridge P is a substantially rectangular parallelepiped. A surface 58 of the hexahedron has an exposed portion 4*b* for transferring the toner image on the photosensitive drum 4, described above, to the intermediate transfer belt unit 11. A surface 59 opposite to the surface 58 has the holding portion 45, described above.

Configuration of Developing Unit

Figure 6:
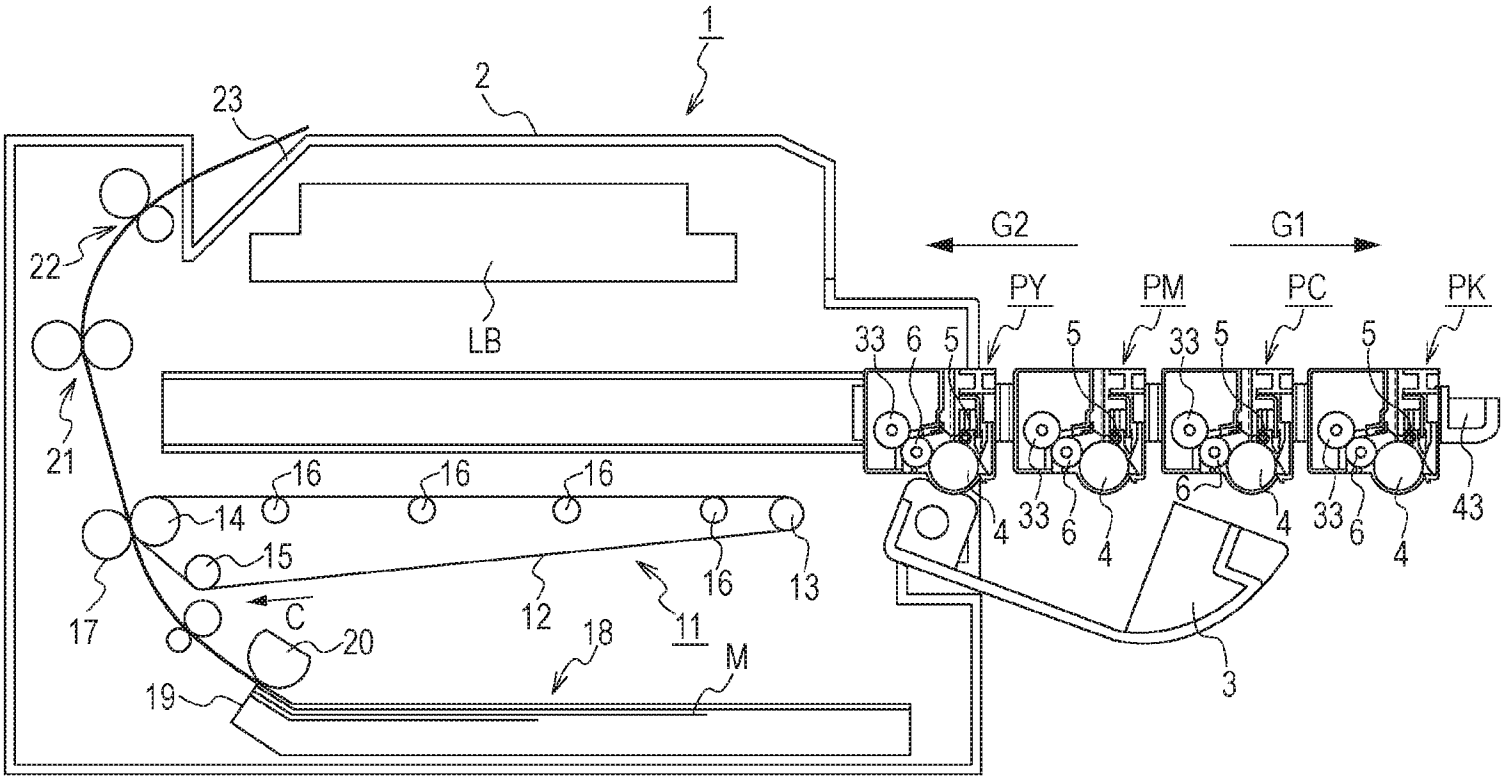
FIG. 6 is a schematic cross-sectional view of cartridges according to a reference example.
Figure 8:
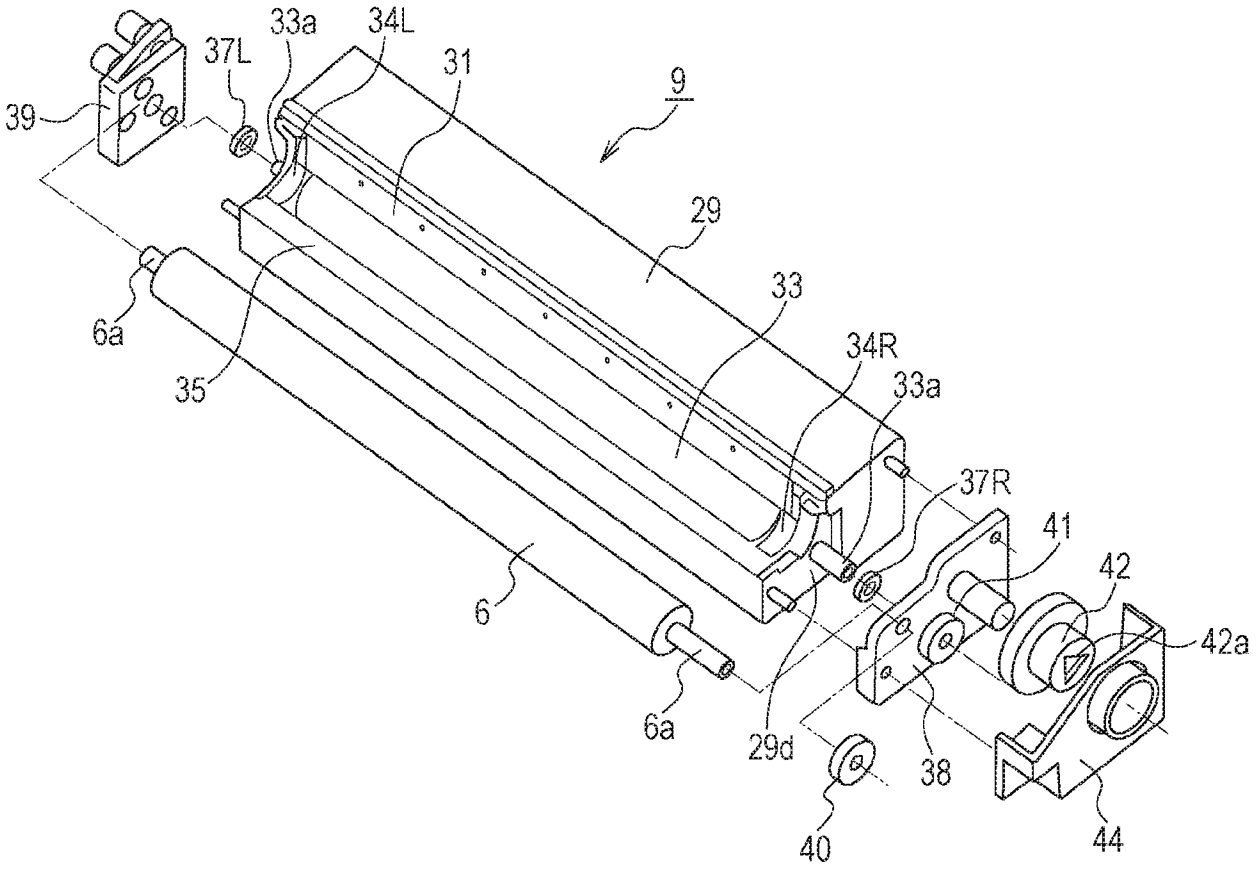
FIG. 8 is a schematic perspective view of a developing unit according to a reference example.

As shown in FIGS. 4 and 6, the developing unit 9 has a longitudinally long shape extending in the direction of the rotation axis of the developing roller 6 serving as a developing unit. In addition to the developing roller 6, the developing unit 9 includes the developing framework 29, a developing blade 31, a developer supply roller 33, development-end sealing members 34R and 34L (see FIG. 8), a flexible sheet 35, and supply-roller-shaft sealing members 37R and 37L (see FIG. 8). The developing framework 29 includes a toner container 29*c* and an opening 29*b* for discharging a toner from the toner container 29*c*. The developing roller 6 and the developer supply roller 33 are disposed in the opening 29*b* of the developing framework 29. As shown in FIG. 8, both ends of the shaft (cores 6*a*) of the developing roller 6 are rotatably supported by a driving-side shaft bearing 38 and a non-driving-side shaft bearing 39 attached to both sides of the developing framework 29. A developing roller gear 40 and a feed roller gear 41 are respectively disposed at the driving ends of the core 6*a* of the developing roller 6 and a core 33*a* of the developer supply roller 33. The gears 40 and 41 engage with a development-drive input gear 42. The development-drive input gear 42 includes a development driving coupling 42*a*, which engages with a drive-output coupling (not shown) of the apparatus main body 2 to transmit the driving force of a driving motor (not shown) of the apparatus main body 2, so that the developing roller 6 and the developer supply roller 33 are rotationally driven at a predetermined speed. The developing blade 31 is an elastic metal thin plate with a thickness of about 0.1 mm. A free end of the developing blade 31 in the lateral direction is in contact with the developing roller 6 in the direction counter to the rotating direction (in the direction of arrow E FIG. 4).

The development-end sealing members 34R and 34L are disposed at both ends of the opening 29*b* of the developing framework 29 to prevent a toner from leaking through the clearance between the developing blade 31 and the developing roller 6 and the developing framework 29, or the second framework. The flexible sheet 35 is disposed in the longitudinal direction at a position opposite to the developing blade 31 in the opening 29*b* of the developing framework 29 so as to be in contact with the developing roller 6 to prevent a toner from leaking through the clearance between the developing framework 29 and the developing roller 6. The supply-roller-shaft sealing members 37R and 37L are attached to portions of the core 33*a* of the developer supply roller 33 exposed to the outside of the developing framework 29 to prevent the toner from leaking through the clearance between a core-member through hole 29*d* in the developing framework 29 and the core 33*a*.

The developing device (developing unit) 9 is constantly urged by a pressure spring (not shown) about the center of rotation (axis a) shown in FIG. 5A in the direction in which the developing roller 6 comes into contact with the photosensitive drum 4 (in the direction of arrow W1 in FIG. 4), so that the developing roller 6 is in contact with the photosensitive drum 4. In forming an image, the developer supply roller 33 and the developing roller 6 rotate to slide frictionally by driving, so that the toner in the developing framework 29 is horn on the developing roller 6. The developing blade 31 controls the thickness of a toner layer formed around the circumferential surface of the developing roller 6 and applies electric charge caused by frictional charging between the developing blade 31 and the developing roller 6 to the toner with contact pressure. The electrically charged toner on the developing roller 6 adheres to the electrostatic image on the photosensitive drum 4 at the point of contact between the developing roller 6 and the photosensitive drums 4 to develop the latent image.

Not during formation of an image, the developing roller 6 is separated from the photosensitive drum 4 to prevent the surface of the developing roller 6 from becoming deformed. In other words, the developing unit 9 can be moved relative to the cleaning unit 8 so that the developing roller 6 can be brought into and out of contact with the photosensitive drum 4.

Configuration for Attaching and Detaching Cartridge to/from Apparatus Main Body

Figure 7:
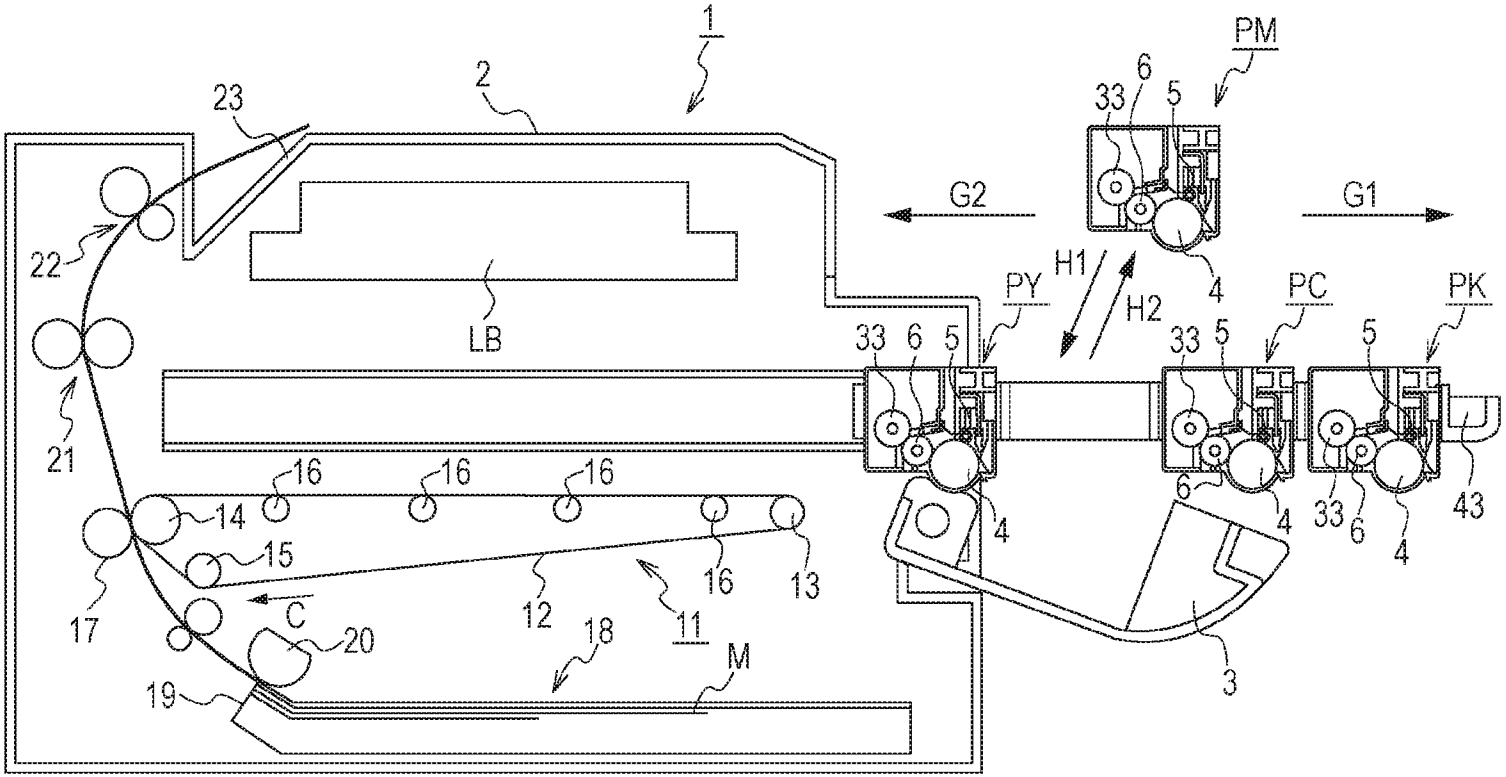
FIG. 7 is a schematic cross-sectional view illustrating an operation of attaching and detaching the cartridge according to a reference example.

Next, the operation to attach and detach the cartridge P to and from the apparatus main body 2 will be described. FIG. 7 is a schematic cross-sectional view of the apparatus main body 2 in a state in which a cartridge tray 43 is drawn from the apparatus main body 2 so that the cartridge P can be attached or detached. The apparatus main body 2 accommodates the cartridge tray 43 in which the cartridge P can be installed. The cartridge tray 43 can be linearly moved (drawn and pushed) from the apparatus main body 2 in directions G1 and G2 substantially in the horizontal direction. The cartridge tray 43 can be placed at an attachment position in the apparatus main body 2 and a drawn position at which the cartridge tray 43 is drawn from the attachment position.

First, the operation to attach the cartridge P to the apparatus min body 2 will be described.

When the door 3 is opened, and the cartridge tray 43 is moved in the direction of arrow G1 in FIG. 6, the cartridge tray 43 moves to the drawn position. In this state, the cartridge P is attached in the cartridge tray 43 from the direction of arrow H1 in FIG. 7 and held thereon. The cartridge tray 43 that holds the cartridge P is moved in the direction of arrow G2 in FIG. 6 to the attachment position in the apparatus main body 2. The door 3 is closed, and thus the operation to attach the cartridge P to the apparatus main body 2 is completed.

Next, the operation to detach the cartridge P from the apparatus main body 2 will be described. The cartridge tray 43 is moved to the drawn position as for the operation to attach the cartridge P to the apparatus main body 2, described above. In this state, the cartridge P is detached in the direction of arrow H2 in FIG. 7, and the operation to detach the cartridge P from the apparatus main body 2 is completed. Thus, the cartridge P can be attached to and detached from the apparatus main body.

Configuration of Packing Member

Figure 1:
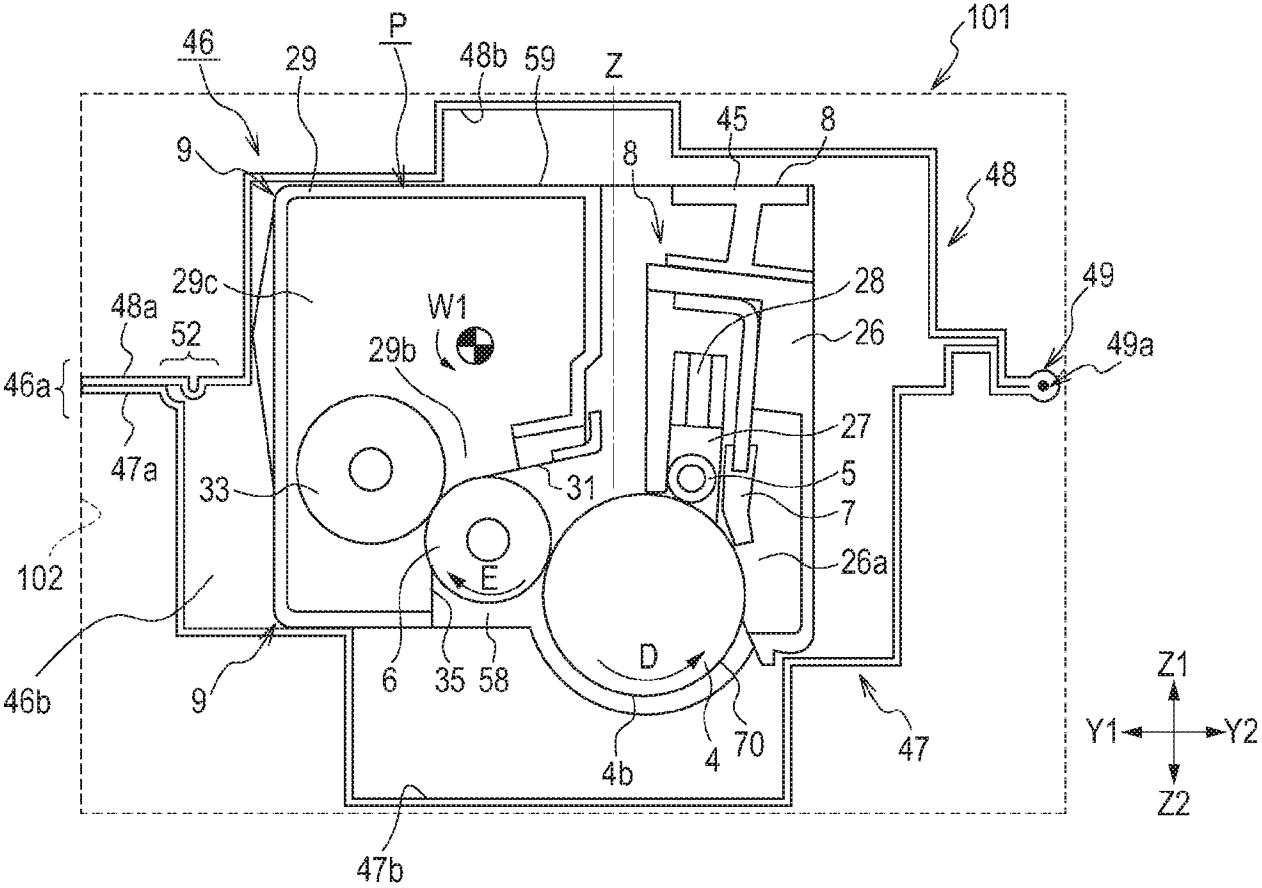
FIG. 1 is a schematic cross-sectional view of a packing member according to a first embodiment of the present invention in a packing state.
Figure 2:
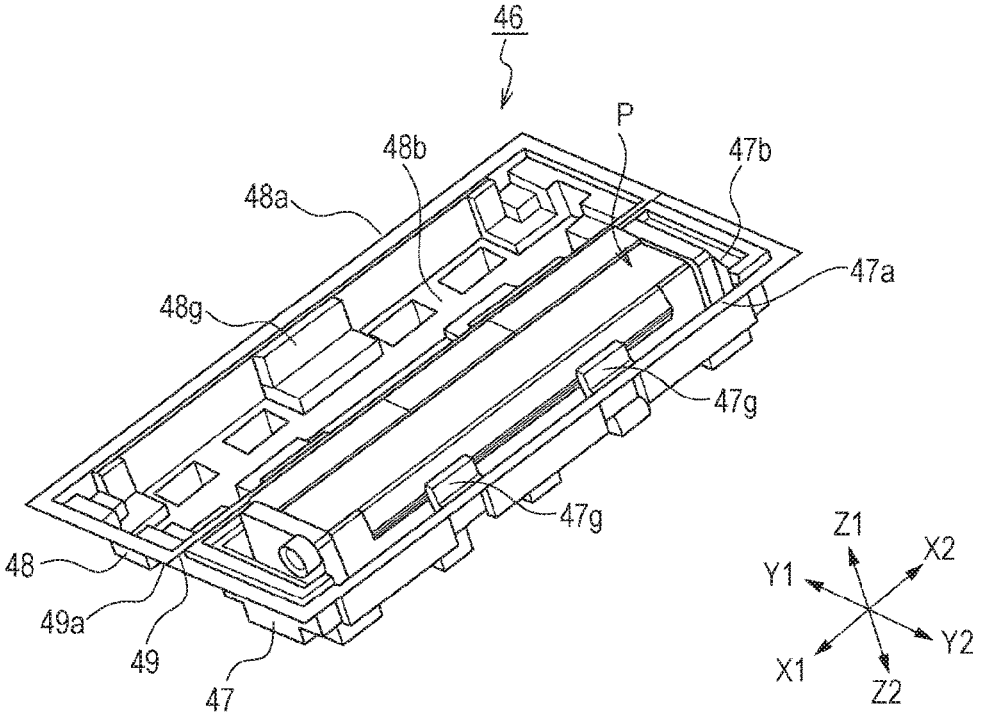
FIG. 2 is a schematic perspective view of the packing member according to the first embodiment in an initial state.
Figure 9:
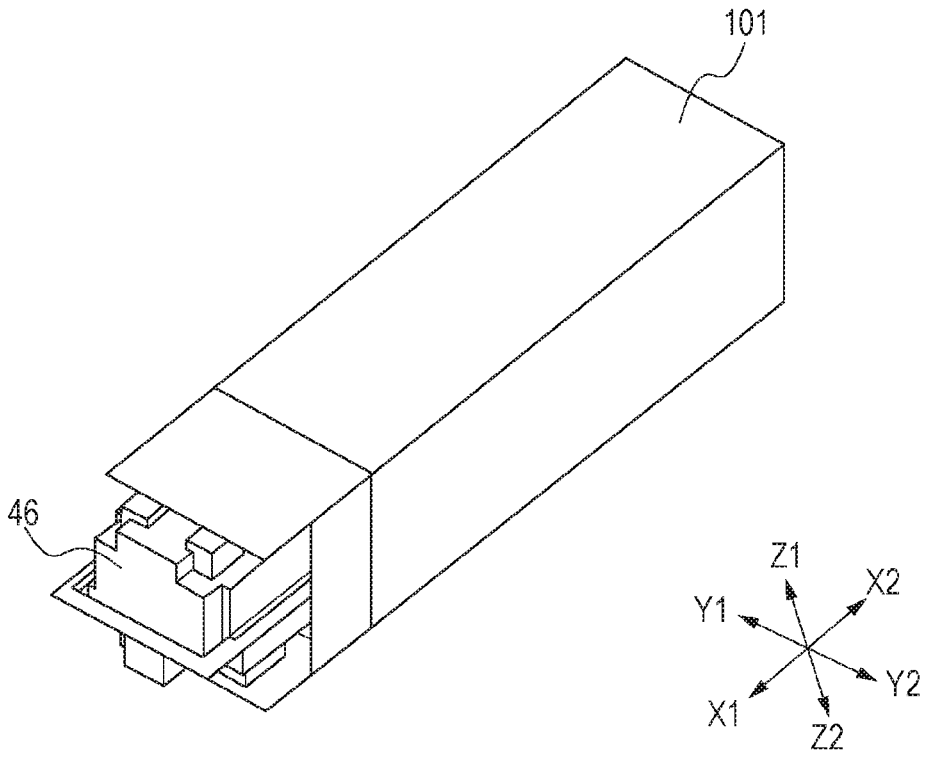
FIG. 9 is a schematic perspective view of the packing member according to the first embodiment in a packed state.

Next, a packing member for the cartridge P will be described with reference to FIGS. 1, 2, and 9. FIG. 1 is a schematic cross-sectional view of the cartridge P and a packing member 46 according to an embodiment of the present invention in a packing state. FIG. 2 is a schematic perspective view of the packing member 46 according to this embodiment in an open state. FIG. 9 is a schematic perspective view of the packing member 46 according to this embodiment in a state in which it is accommodated in a box 101.

As shown in FIG. 2, the packing member 46 includes a frame member 47, a lid 48, and a hinge 49. The frame member 47 and the lid 48 are connected at one end with the hinge 49 into a single unit and are rotatable about a rotation shaft 49*a* of the hinge 49. The frame member 47 includes a first recessed portion 47*b* and a first flange 47*a* around the outer periphery of the first recessed portion 47*b*. The lid 48 includes a second recessed portion 48*b* and a second flange 48*a* around the outer periphery of the second recessed portion 48*b*. The hinge 49, the first flange 47*a*, and the second flange 48*a* are provided in a longitudinal direction.

As shown in FIG. 2, the cartridge P is disposed in the first recessed portion 47*b* of the packing member 46. Thereafter, the lid 48 is rotated about 180° about the hinge 49, and part of the first flange 47*a* and part of the second flange 48*a* are welded together with heat to form a joined surface 46*a*, so that the packing member 46 can be brought to a packing state, as shown in FIG. 1. In this packing state, the cartridge P is accommodated and held in an accommodation space 46*b* formed by the first recessed portion 47*b* of the frame member 47 and the second recessed portion 48*b* of the lid 48. The packing member 46 in the packing state is put in the box 101 so that the cartridge P can be transported. The packing member 46 is stored in such a manner that at least one of the first flange 47*a* and the second flange 48*a* of the packing member 46 can he in contact with an inside wall surface 102 of the box 101. in contrast to the packing state, an unpacking state in which the first flange 47*a* and the second flange 48*a* of the packing member 46 are not joined so that the cartridge P can be attached to and detached from the packing member 46 is an initial state.

The packing member 46 is made of a thin plastic plate, such as polyethylene terephthalate (PET) or polypropylene (PP). Forming the packing member 46 with such a thin plastic plate allows the cartridge P to be packed in a smaller space than that with a conventional packing method using a cushioning material, such as foam polystyrene.

Example methods for forming the packing member 46 include vacuum forming, air-pressure foaming, vacuum air-pressure forming, draw forming, and injection molding. The vacuum forming is a method of forming a heated resin sheet into a predetermined shape by sucking the heated resin sheet into a mold. The air-pressure forming is a method of forming a heated resin sheet into a predetermined shape by bringing the heated resin sheet into contact with a mold using compressed air. The vacuum air-pressure forming is a method of forming a heated resin sheet into a predetermined shape using both the vacuum forming and the air-pressure forming. The draw forming is a method of forming a heated resin sheet into a predetermined shape by fixing the heated resin sheet to a female mold and compressing it with a male mold. The injection molding is a method of forming a molten resin into a predetermined shape by injecting the molten resin into a space formed by a female mold and a male mold. The vacuum forming and the air-pressure forming allow components to be formed at lower cost than the draw forming and the injection molding do. However, the draw forming, the injection molding, or the vacuum air-pressure forming in which the vacuum forming and the air-pressure forming are combined may be used rather than the vacuum forming and the air-pressure forming from the viewpoint of increasing the dimension accuracy of the molded product.

In this embodiment, the first recessed portion 47*b* of the frame member 47 has first force receiving portions 47*g*, and the second recessed portion 48*b* of the lid 48 has a second force receiving portion 48*g*. The first force receiving portions 47*g* and the second force receiving portion 48*g* are perpendicular to the joined surface 46*a* and protruding inward from the first recessed portion 47*b* and the second recessed portion 48*b* of the packing member 46 and are disposed at positions separate from the joined surface 46*a*. The first force receiving portions 47*g* and the second force receiving portion 48*g* allow the position of a supporting portion S, which comes into contact with the cartridge P when the load N of the cartridge P is applied normally or when an impact is given, to be held within a predetermined range. In addition to a force receiving portion protruding from the first recessed portion 47*b* of the frame member 47 with respect to the first flange 47*a* toward the lid 48, like the first force receiving portions 47*g* shown in FIG. 2, a force receiving portion protruding from the second recessed portion 48*b* of the lid 48 toward the frame member 47 may be provided. This configuration allows assisting the opening and closing of the frame member 47 and the lid 48. Furthermore, the first force receiving portions 47*g* and the second force receiving portion 48*g* may be used to position the cartridge P packed in the packing member 46.

The configuration of a bent portion provided at a flange, which is a feature of an embodiment of the present invention will be described in detail below.

Bent Portion

Problems of a related-art example having no bent portion will be specifically described with reference to FIGS. 10A and 10B and FIGS. 11A and 11B, and then the configuration and advantages of a bent portion according to an embodiment of the present invention will be described with reference to FIGS. 12A and 12B to FIG. 19, Related-Art Example The behavior of a packing member of a related-art example differs depending on whether the coefficient of static friction μ against the inside wall surface 102 of the box 101, with which the packing member conies into contact in addition to the packing member, is large or small. Therefore, a separate description is made for a case where the coefficient of static friction μ is large and a case where it is small with reference to FIGS. 11A and 11B. Reference sign N is a load applied from the cartridge P to the lid 48 of the packing member 46 due to a drop or the like; L is the height of the lid flange (second flange) 48*a* of the lid 48 in the vertical direction (Y1-direction) in a state in which the lid flange 48*a* is in contact with the inside wall surface 102 of the box 101; D is the distance from the lid flange 48*a* to the position of contact between the cartridge P and the lid 48 in the horizontal direction (Z-direction); O is the position of contact between the inside wall surface 102 of the box 101 and the lid flange 48*a*; and μ is the coefficient of static friction of the packing member 46 and the box 101. The following describes a configuration in which the load N of the cartridge P is applied to the lid 48 by way of example. When the load N of the cartridge P is applied to the lid 48, the lid 48 is deformed to absorb most of the drop impact of the cartridge P. The shape of the lid 48, which has a significant effect in absorbing and reducing an impact, will be described.

When Coefficient of Static Friction mu Is Large

Figure 11A:
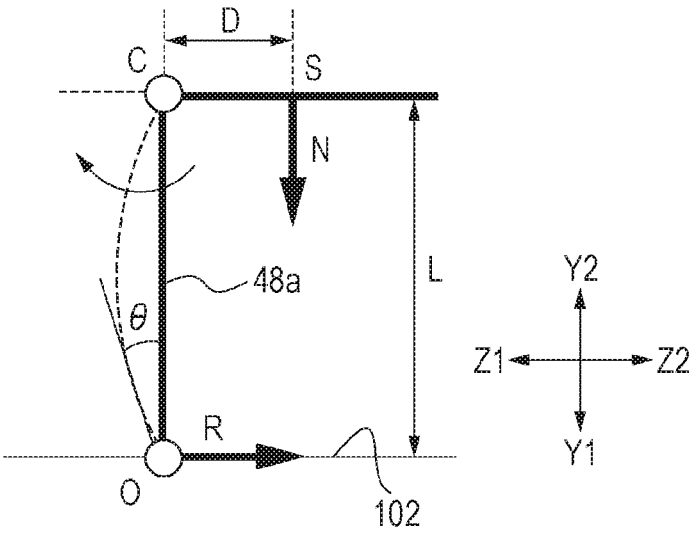
FIG. 11A is a partially enlarged view of a packing member according to a related-art example.

FIG. 11A is a schematic cross-sectional view illustrating the behavior of the lid flange 48*a* when the coefficient of static friction μ at the portion of contact between the lid flange 48*a* and the inside wall surface 102 of the box 101 is large. The following discusses a moment about an end C of the lid flange 48*a* on a vertical line (Y-axis) on the position of contact O between the lid flange 48*a* and the inside wall surface 102 of the box 101 in a state in which the lid flange 48*a* is in contact with the inside wall surface 102 of the box 101. The load N of the cartridge P is applied to the supporting portion S separate from the contact position O by distance D in the horizontal direction. In other words, since a line along the joined surface 46*a* is in the vertical direction, the load N is applied to the supporting portion S separate from the end C by the distance D.

Figure 10A:
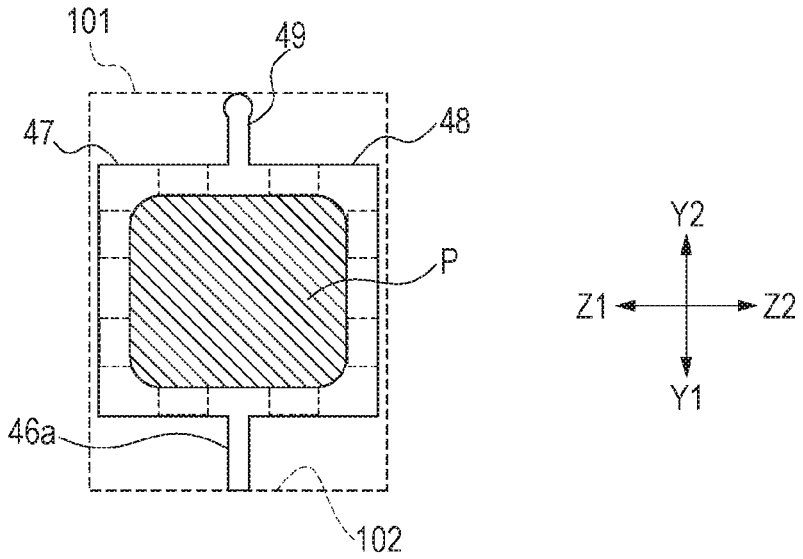
FIG. 10A is a schematic cross-sectional view of a packing member according to a related-art example.
Figure 10B:
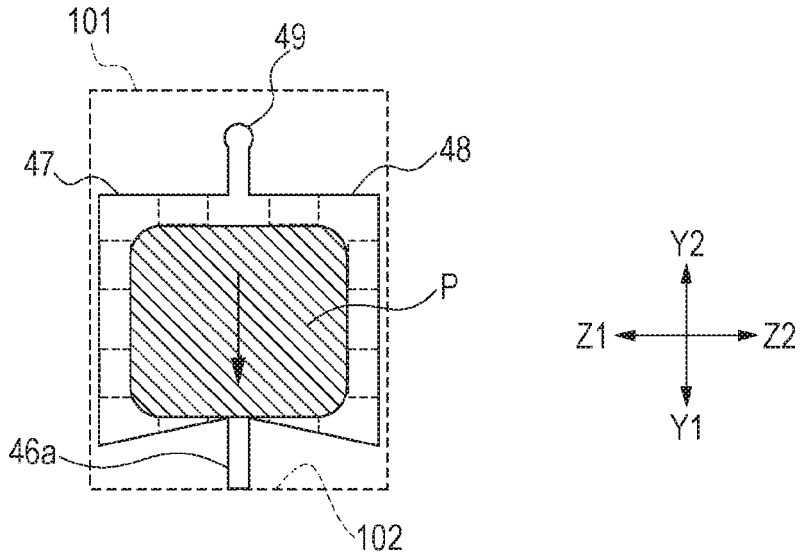
FIG. 10B is a schematic cross-sectional view of the packing member according to the related-art example.

The load N causes a moment with a magnitude of N*D that causes a rotation in a Z1-direction. In contrast, a frictional force R with a magnitude μN is generated in a Z2-direction opposite to the Z1-direction between the lid flange 48*a* and the box 101. This frictional force R causes a moment with a magnitude of μN*L that causes a rotation in the Z2-direction. In other words, when the coefficient of static friction μ at the portion of contact between the lid flange 48*a* and the inside wall surface 102 of the box 101 is large, a large frictional force R is generated. Therefore, even if a drop impact or the like, that is, a load, is applied, the lid flange 48*a* does not slide with respect to the box 101, thus causing no change in contact position O. As a result, when the load N due to an impact is applied, the lid flange 48*a* is gradually curved so as to protrude in the Z1-direction (toward the frame member 47) and starts to slide in the Z1-direction as the frictional force R decreases. The condition that the lid flange 48*a* is deformed at the position of contact O between the lid flange 48*a* and the box 101 and starts to slide relative to the box 101 is expressed as [Exp. 1]:

$$\theta > \tan^{-1} \mu \qquad \text{[Exp. 1]}$$

where θ is the inclination of the lid flange 48*a* to the vertical line (Y-axis), Accordingly, with a large coefficient of static friction μ, if the inclination θ is not large, the lid flange 48*a* does not start to slide relative to the box 101, so that the contact position O does not move in the Z1-direction (toward the frame member 47). In particular, the lid 48 is less prone to become deformed, and the inclination θ decreases as the distance D approaches 0. This makes it difficult for the contact position O to move in the Z1-direction (toward the frame member 47). Thus, the lid 48 cannot be deformed to reduce and absorb the impact. Furthermore, as shown in FIG. 10A, the first flange 47*a* of the frame member 47 and the second flange 48*a* of the lid 48 are overlapped along the joined surface 46*a*. This configuration makes it difficult to deform the second flange 48*a*, so that the inclination θ decreases, in case of an impact in a direction (Y2-direction) opposite to the vertical direction. This makes it difficult for the contact position O to move in the Z1-direction (toward the frame member 47), so that an impact on the cartridge P cannot be sufficiently absorbed. If the box 101 drops in the Y1-direction along the joined surface 46*a*, the joined surface 46*a* is not curved but stands erect against the inside wall surface 102, as shown in FIG. 10B, so that a force from the inside wall surface 102 can be directly transmitted to the cartridge P, causing an excessive force to be applied.

When Coefficient of Static Friction mu Is Small

Figure 11B:
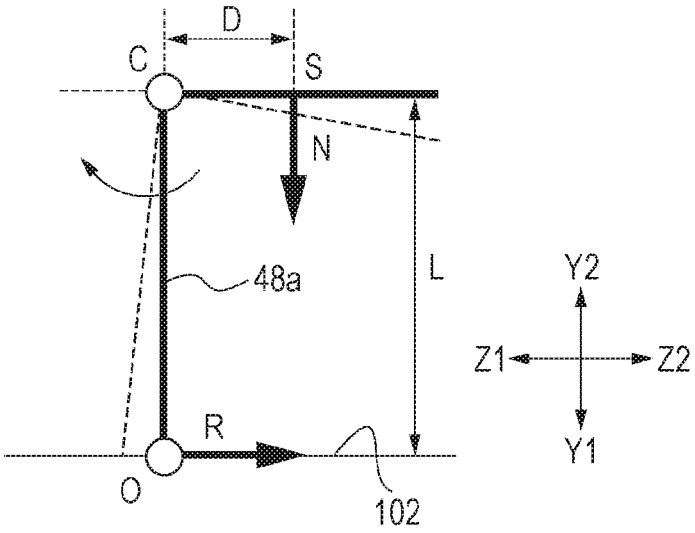
FIG. 11B is a partially enlarged view of a packing member according to a related-art example.

FIG. 11B is a schematic cross-sectional view illustrating the behavior of the lid flange 48*a* when the coefficient of static friction μ at the portion of contact between the lid flange 48*a* and the inside wall surface 102 of the box 101 is small. The load N causes a moment with a magnitude of N*D that causes a rotation in the Z1-direction. In contrast, a frictional force R with a magnitude μN is generated in the Z2-direction opposite to the Z1-direction between the lid flange 48*a* and the, box 101. This frictional force R causes a moment with a magnitude of μN*L that causes a rotation in the Z2-direction. When the coefficient of static friction μ at the portion of contact between the lid flange 48*a* and the inside wall surface 102 of the box 101 is small, the moment generated due to a drop impact, that is, the load N, is larger than the moment generated due to the frictional force R, so that the lid flange 48*a* slides in the Z1-direction. Accordingly, the condition that the lid flange 48*a* starts to slide relative to the box 101 is expressed as [Exp. 2]:

$$D < \mu * L \qquad \text{[Exp. 2].}$$

However, if the load N is applied in the vertical direction (Y1-direction) to a position at which the distance D from the lid flange 48*a* to the, position of contact O between the cartridge P and the lid 48 is 0, that is, the joined surface 46*a*, no moment is generated due to the load N. Therefore, if the load N is applied in the Y1-direction, an impact on the cartridge P cannot be sufficiently absorbed and cushioned by the bending deformation of the joined surface 46*a* and the elastic deformation or plastic deformation of the packing member 46, Furthermore, if the box 101 drops in the Y1-direction along the joined surface 46*a*, the joined surface 46*a* is not curved but stands erect, as shown in FIG. 10B, so that the force from the inside wall surface 102 is directly transmitted to the cartridge P, causing an excessive force to be applied.

First Embodiment

The configuration of a packing member 46 having a bent portion 52 according to a first embodiment of the present invention will be described with reference to FIGS. 12A and 12B. In the first embodiment, the bent portion 52 provides with respect to the joined surface 46*a* in a direction from the lid 48 toward the frame member 47, that is, in the Z1-direction perpendicular to the joined surface 46*a*. A description is made for a case where the cartridge P is supported by the lid 48 of the packing member 46, as in the related art.

This embodiment will also be described as applied to a case where the coefficient of static friction μ at the portion of contact between the lid flange 48*a* and the inside wall surface 102 of the box 101 is large and a case where it is small.

<When Coefficient of Static Friction mu Is Large>

Figure 12A:
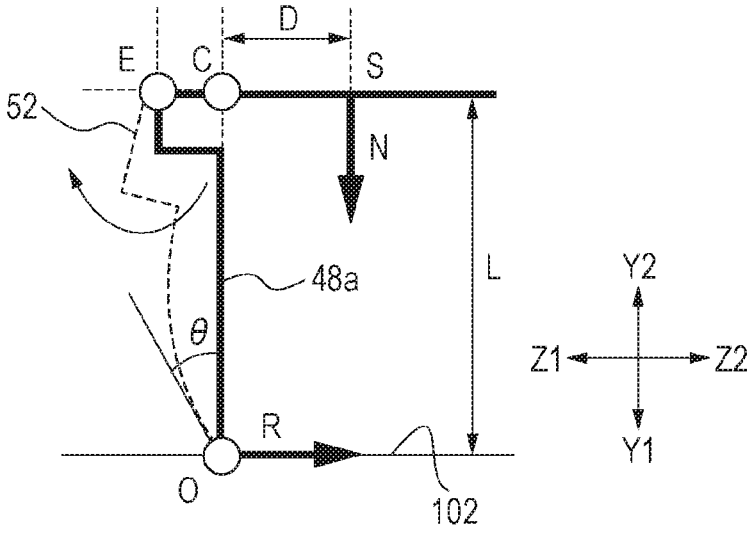
FIG. 12A is a partially enlarged view of the packing member according to the first embodiment of the present invention.

FIG. 12A is a schematic cross-sectional view illustrating the behavior of the lid flange 48*a* when the coefficient of static friction μ at the portion of contact between the lid flange 48*a* and the inside wall surface 102 of the box 101 is large. The following discusses a moment about an end C of the lid flange 48*a* on a vertical line (Y-axis) on the position of contact O between the lid flange 48*a* and the inside wall surface 102 of the box 101 in a state in which the lid flange 48*a* is in contact with the inside wall surface 102 of the box 101. The load N of the cartridge P is applied to the supporting portion S separate from the contact position O by distance D in the horizontal direction. In other words, since a line along the joined surface 46*a* is in the vertical direction, the load N is applied to the supporting portion S separate from the end C by the distance D.

The load N causes a moment with a magnitude of N*D that causes a rotation in the Z1-direction. In contrast, a frictional force R with a magnitude μN is generated in a Z2-direction opposite to the Z1-direction between the lid flange 48*a* and the box 101. This frictional force R causes a moment with a magnitude of μN*L that causes a rotation in the Z2-direction.

In this embodiment, the position of contact O between the lid flange 48*a* and the inside wall surface 102 of the box 101 is disposed, in the horizontal direction, between the bent portion 52 and the supporting portion S to which the load Nis applied. This causes the lid 48 to become deformed about the bent portion 52, more specifically, a corner E of the bent portion 52, when the load N is applied. Thus, when a large force due to a drop impact or the like is applied, the bent portion 52 becomes deformed, allowing the frictional force R to be reduced. This can decrease the moment caused by the frictional force R, allowing the lid flange 48*a* to be slid from the contact position O relative to the box 101 even if the coefficient of static friction ra, at the portion of contact between the lid flange 48*a* and the inside wall surface 102 of the box 101 is large. Thus, if the box 101 drops in the Y1-direction to have an impact, the impact on the cartridge P can be sufficiently absorbed and cushioned by the bending deformation of the joined surface 46*a* and the elastic deformation or plastic deformation of the packing member 46.

Furthermore, in this embodiment, even if the distance D from the lid flange 48*a* to the position of contact O between the cartridge P and the lid 48 is 0 in the horizontal direction, the lid 48 becomes deformed about the bent portion 52, more specifically, the corner E of the bent portion 52. This allows the frictional force R to be reduced even if the coefficient of static friction μ at the portion of contact between the lid flange 48*a* and the inside wall surface 102 of the box 101 is large, allowing the lid flange 48*a* to be slid from the contact position O relative to the box 101. Thus, if the box 101 drops to have an impact in the Y1-direction, the impact on the cartridge P can be sufficiently absorbed and cushioned by the bending deformation of the joined surface 46*a* and the elastic deformation or plastic deformation of the packing member 46. In other words, if the box 101 drops in the Y1-direction to have an impact, this configuration prevents the joined surface 46*a* from not becoming curved but standing erect, as shown in FIG. 10B, and thus prevents a force from the inside wall surface 102 from being directly transmitted to the cartridge P to cause an excessive force.

<When Coefficient of Static Friction mu Is Small>

Figure 12B:
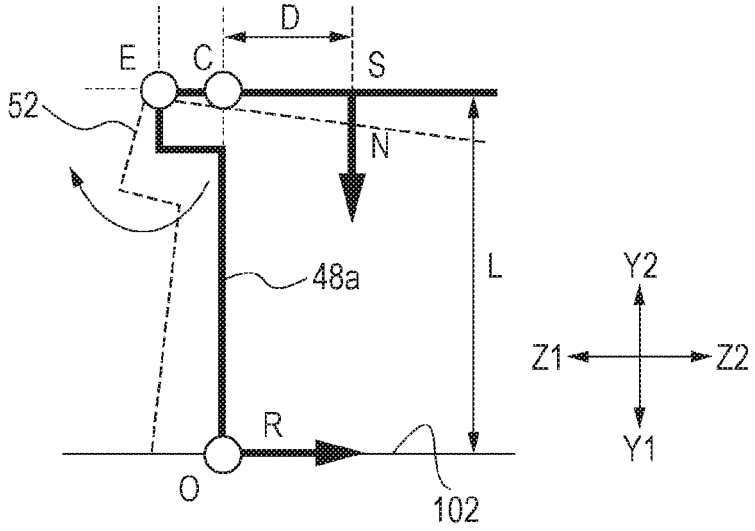
FIG. 12B is a partially enlarged view of the packing member according to the first embodiment of the present invention.

FIG. 12B is a schematic cross-sectional view illustrating the behavior of the lid flange 48*a* when the coefficient of static friction μ at the portion of contact between the lid flange 48*a* and the inside wall surface 102 of the box 101 is small, The load N causes a moment with a magnitude of N*D that causes a rotation in the Z1-direction. In contrast, a frictional force R with a magnitude μN is generated in the Z2-direction opposite to the Z1-direction between the lid flange 48*a* and the box 101. This frictional force R causes a moment with a magnitude of μN*L that causes a rotation in the Z2-direction. When the coefficient of static friction μ at the portion of contact between the lid flange 48*a* and the inside wall surface 102 of the box 101 is small, the moment generated due to a drop impact, that is, the load N, is larger than the moment generated due to the frictional force R, so that the lid flange 48*a* slides in the Z1-direction, as in the related-art example.

In addition, if the load N is applied in the vertical direction (Y1-direction) to a position at which the distance D from the lid flange 48*a* to the position of contact O between the cartridge P and the lid 48 is 0, that is, to the joined surface 46*a*, this embodiment allows a rotational moment to be well generated. More specifically, when the load N is applied, the lid 48 becomes deformed about the bent portion 52, more specifically, the corner E of the bent portion 52. Thus, when a large force due to a drop impact or the like is applied, the bent portion 52 becomes deformed, allowing the frictional force R to be reduced. This can decrease the moment caused by the frictional force R, allowing the lid flange 48*a* to be slid from the contact position O relative to the box 101 even if the coefficient of static friction μ at the portion of contact between the lid flange 48*a* and the inside wall surface 102 of the box 101 is small. Thus, if the box 101 drops in the Y1-direction to have an impact, the impact on the cartridge P can be sufficiently absorbed and cushioned by the bending deformation of the joined surface 46*a* and the elastic deformation or plastic deformation of the packing member 46. In other words, if the box 101 drops in the Y1-direction to have an impact, this configuration prevents the joined surface 46*a* from not becoming curved but standing erect, as shown in FIG. 10B, and thus prevents a force from the inside wall surface 102 from being directly transmitted to the cartridge P to cause an excessive force.

Second Embodiment

The configuration of a bent portion 53 according to a second embodiment of the present invention will be described with reference to FIGS. 13A and 13B. In the second embodiment, the bent portion 53 protrudes with respect to the joined surface 46*a* in a direction from the frame member 47 toward the lid 48, that is, in the Z2-direction perpendicular to the joined surface 46*a*. A description is made for a case where the cartridge P is supported by the lid 48 of the packing member 46, as in the related art. This embodiment will also be described as applied to a case where the coefficient of static friction μ is large and a case where it is small.

(When Coefficient of Static Friction mu Is Large)

Figure 13A:
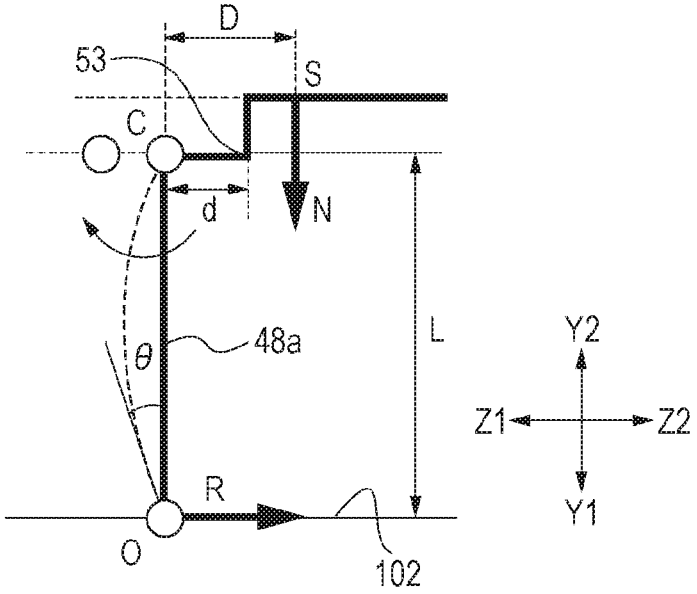
FIG. 13A is a partially enlarged view of a packing member according to a second embodiment of the present invention.

FIG. 13A is a schematic cross-sectional view illustrating the behavior of the lid flange 48*a* when the coefficient of static friction μ at the portion of contact between the lid flange 48*a* and the inside wall surface 102 of the box 101 is large.

The following discusses a moment about the end C of the lid flange 48*a* on a vertical line (Y-axis) on the position of contact O between the lid flange 48*a* and the inside wall surface 102 of the box 101 in a state in which the lid flange 48*a* is in contact with the inside wall surface 102 of the box 101.

The load N of the cartridge P is applied to the supporting portion S separate from the contact position O by distance D in the horizontal direction. In other words, since a line along the joined surface 46*a* is in the vertical direction, the load N is applied to the supporting portion S separate from the end C by the distance D.

The load N causes a moment with a magnitude of N*D that causes a rotation in the Z1-direction. In contrast, a frictional force R with a magnitude μN is generated in a Z2-direction opposite to the Z1-direction between the lid flange 48*a* and the box 101. This frictional force R causes a moment with a magnitude of μN*L that causes a rotation in the Z2-direction. In this embodiment, the bent portion 53 is disposed so that the position of contact O between the lid flange 48*a* and the inside wall surface 102 of the box 101 is located, in the horizontal direction, between the bent portion 53 and the supporting portion S to which the load N is applied. This causes the lid 48 to become deformed about the bent portion 53, more specifically, a corner E of the bent portion 53, when the load N is applied. Thus, when a large force due to a drop impact or the like is applied, the bent portion 53 becomes deformed, allowing the frictional force R to be reduced. This can decrease the moment caused by the frictional force R, allowing the lid flange 48*a* to be slid from the contact position O relative to the box 101 even if the coefficient of static friction μ at the portion of contact between the lid flange 48*a* and the inside wall surface 102 of the box 101 is large. Thus, if the box 101 drops in the Y1-direction to have an impact, the impact on the cartridge P can be sufficiently absorbed and cushioned by the bending deformation of the joined surface 46*a* and the elastic deformation or plastic deformation of the packing member 46.

Furthermore, the bent portion 53 of this embodiment has a length d in the horizontal direction. This prevents the distance D from the supporting portion S of the lid flange 48*a* that receives the load N to the, position of contact O between the cartridge P and the lid 48 from reaching 0. This prevents, even if the box 101 drops in the Y1-direction to have an impact, the joined surface 46*a* from not being curved and standing erect against the inside wall surface 102 to transmit the force from the inside wall surface 102 directly to the cartridge P to impose an excessive force.

(When Coefficient of Static Friction mu Is Small)

Figure 13B:
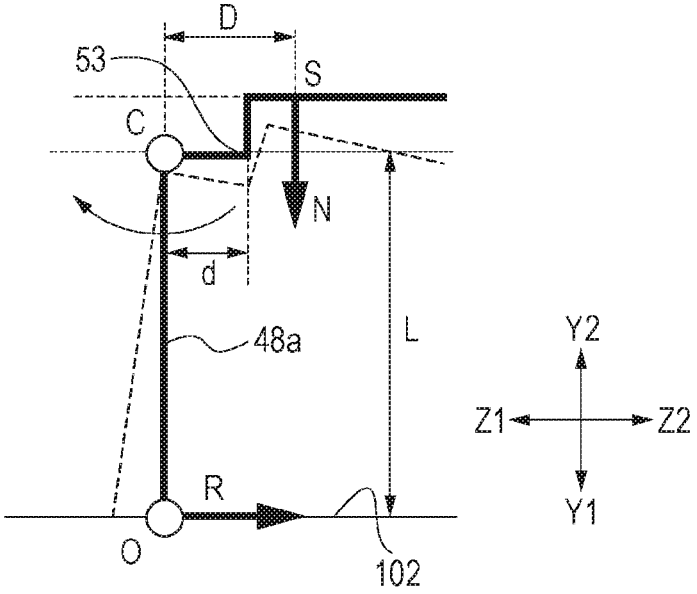
FIG. 13B is a partially enlarged view of the packing member according to the second embodiment of the present invention.

FIG. 13B is a schematic cross-sectional view illustrating the behavior of the lid flange 48*a* when the coefficient of static friction μ at the portion of contact between the lid flange 48*a* and the inside wall surface 102 of the box 101 is small. The load N causes a moment with a magnitude of N*D that causes a rotation in the Z1-direction. contrast, a frictional force R with a magnitude μN is generated in the Z2-direction opposite to the Z1-direction between the lid flange 48*a* and the box 101. This frictional force R causes a moment with a magnitude of μN*L that causes a rotation in the Z2-direction. When the coefficient of static friction μ at the portion of contact between the lid flange 48*a* and the inside wall surface 102 of the box 101 is small, the moment generated due to a drop impact, that is, the load N, is larger than the moment generated due to the frictional force R, so that the lid flange 48*a* slides in the Z1-direction, as in the related-art example.

Furthermore, the bent portion 53 of this embodiment has a length d in the horizontal direction. This prevents the distance D from the supporting portion S of the lid flange 48*a* that receives the load N to the position of contact O between the cartridge P and the lid 48 from reaching 0. This prevents, even if the box 101 drops in the Y1-direction to have an impact, the joined surface 46*a* from not being curved and standing erect against the inside wall surface 102 to transmit the force from the inside wall surface 102 directly to the cartridge P to impose an excessive force.

Third Embodiment

In the above embodiments, the bent portion is disposed at the lid 48. The present invention is not limited to this configuration the bent portion may be disposed at the frame member 47 instead of the lid 48. The same advantageous effect is given even if the configurations of the flanges 48*a* and 47*a* of the lid 48 and the frame member 47 are interchanged. Both of the lid 48 and the frame member 47 may have a bent portion. In a third embodiment, a configuration in which both of the lid 48 and the frame member 47 have a bent portion will be described with reference to FIG. 14.

Figure 14:
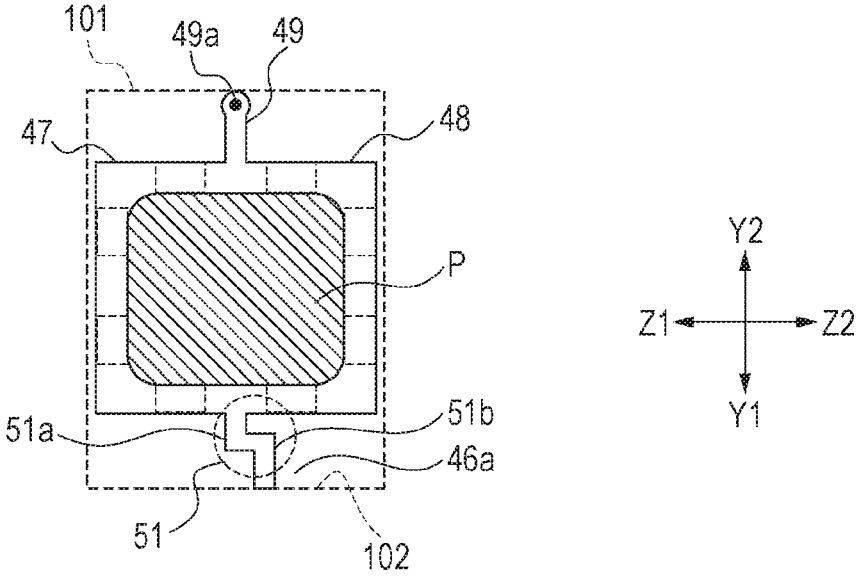
FIG. 14 is a schematic cross-sectional view of a packing member according to a third embodiment of the present invention.

This embodiment will also be described as applied to a case where the coefficient of static friction μ at the portion of contact between the lid flange 48*a* and the inside wall surface 102 of the box 101 is large and a case where it is small. In this embodiment, as shown in FIG. 14, the lid 48 has a first bent portion 51*a* protruding with respect to the joined surface 46*a* in a direction from the lid 48 toward the frame member 47, that is, in the Z1-direction perpendicular to the joined surface 46*a*, as in the first embodiment. Likewise, the frame member 47 has a second bent portion 51*b* protruding with respect to the joined surface 46*a* in a direction from the lid 48 toward the frame member 47, that is, in the Z1-direction perpendicular to the joined surface 46*a*. The configuration in which the first flange 47*a* has the first bent portion 51*a*, and the second flange 48*a* has the second bent portion 51*b* to form a bent portion 51 including the first bent portion 51*a* and the second bent portion 51*b* will he described.

{When Coefficient of Static Friction mu Is Large}

(1) When Load N Is Applied to Lid 48

In this embodiment, the position of contact O between the lid flange 48*a* and the inside wall surface 102 of the box 101 is disposed, in the horizontal direction, between the second bent portion 51*b* and the supporting portion S to which the load N is applied. This causes the lid 48 to become deformed about the second bent portion 51*b* when the load N is applied. Thus, when a large force due to a drop impact or the like is applied, the frictional force R can be reduced by the deformation of the second bent portion 51*b*. Thus, even if the coefficient of static friction μ at the portion of contact between the lid flange 48*a* and the inside wall surface 102 of the box 101 is large, the frictional force R can be reduced, allowing the lid flange 48*a* to be slid from the contact position O relative to the box 101. Thus, if a force in the Y1-direction is given, an impact on the cartridge P can be sufficiently absorbed and cushioned by the bending deformation of the joined surface 46*a* and the elastic deformation or plastic deformation of the packing member 46.

Furthermore, in this embodiment, even if the distance D from the lid flange 48*a* to the position of contact O between the cartridge P and the lid 48 is 0 in the horizontal direction, a moment due to the load N can be well generated, and the frictional force R can be reduced. This allows the lid flange 48*a* to be slid from the contact position O relative to the box 101. Thus, if a force in the Y1-direction is given, an impact on the cartridge P can be sufficiently absorbed and cushioned by the packing member 46.

(2) When Load N Is Applied to Frame member 47

As in the second embodiment, the load N causes a moment with a magnitude of N*D that generates a rotation in the Z2-direction. In contrast, a frictional force R with a magnitude of μN is generated in the Z2-direction opposite to the Z1-direction between the frame member flange (first flange) 47*a* and the box 101. This frictional force R causes a moment with a magnitude of μN*L that causes a rotation in the Z2-direction. Thus, when a large force due to a drop impact or the like is applied, the first bent portion 51*a* and the frame member flange 47*a* become deformed to reduce the frictional force R, allowing the lid flange 48*a* to be slid from the contact position O relative to the box 101. Thus, if a force in the Y2-direction is given, an impact on the cartridge P can be sufficiently absorbed and cushioned by the bending deformation of the joined surface 46*a* and the elastic deformation or plastic deformation of the packing member 46.

{When Coefficient of Static Friction mu Is Small}

(1) When Load N Is Applied to Lid 48

As in the related-art example, when the coefficient of static friction μ at the portion of contact between the lid flange 48*a* and the inside wall surface 102 of the box 101 is small, a moment generated due to a drop impact, that is, the load N, is larger than a moment generated due to the frictional force R, so that the lid flange 48*a* slides in the Z1-direction.

Furthermore, as in the first embodiment, even if the load N is applied in the vertical direction (Y1-direction) to a position at which the distance D from the lid flange 48*a* to the position of contact O between the cartridge P and the lid 48 is 0, in other words, to the joined surface 46*a*, a rotational moment can be generated. Thus, when a large force due to a drop impact or the like is applied, the second bent portion 51*b* becomes deformed to reduce the frictional force R. Thus, even if the coefficient of static friction μ at the portion of contact between the lid flange 48*a* and the inside wall surface 102 of the box 101 is large, the frictional force R can be reduced, allowing the lid flange 48*a* to be slid from the contact position O relative to the box 101. Thus, if a force in the Y1-direction is given, an impact on the cartridge P can be sufficiently absorbed and cushioned by the bending deformation of the joined surface 46*a* and the elastic deformation or plastic deformation of the packing member 46.

(2) When Load N Is Applied to Frame Member 47

As in the second embodiment, the load N causes a moment with a magnitude of N*D that generates a rotation in the Z2-direction. In contrast, a frictional force R with a magnitude of μN is generated in the Z2-direction opposite to the Z1-direction between the frame member flange 47*a* and the box 101. This frictional force R causes a moment with a magnitude of μN*L that causes a rotation in the Z2-direction. Thus, when the coefficient of static friction μ at the portion of contact between the lid flange 48*a* and the inside wall surface 102 of the box 101 is small, a moment generated due to a drop impact, that is, the load N, is larger than the moment generated due to the frictional force R, so that the lid flange 48*a* slides in the Z2-direction.

Furthermore, the first bent portion 51*a* of this embodiment is provided in the horizontal direction. This prevents the distance D from the supporting portion S of the frame member 47 that receives the load N of the cartridge P to the position of contact O between the frame member flange 47*a* and the box 101 from reaching 0. This prevents, even if the box 101 drops in the Y1-direction to have an impact, the joined surface 46*a* from not being curved and standing erect against the inside wall surface 102 to transmit the force from the inside wall surface 102 directly to the cartridge P to impose an excessive force.

Thus, in both cases, an impact during transportation of the cartridge P can be absorbed and cushioned by the packing member 46 with a simple structure, preventing transmission of the impact to the cartridge P.

Modifications

Figure 15A:
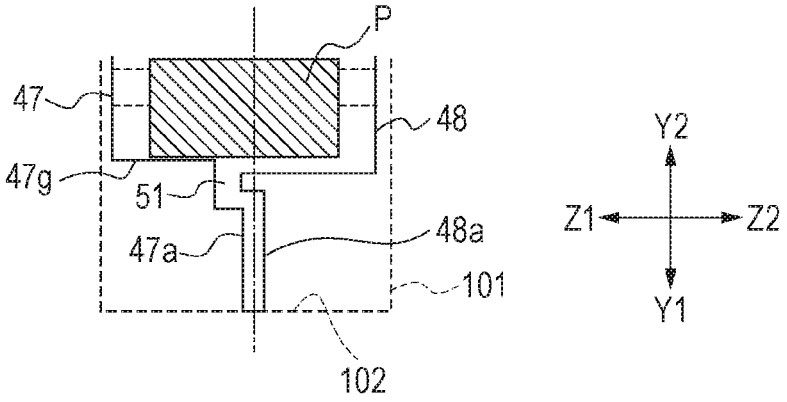
FIG. 15A is a schematic cross-sectional view illustrating a packing member according to a modification of the third embodiment.
Figure 15B:
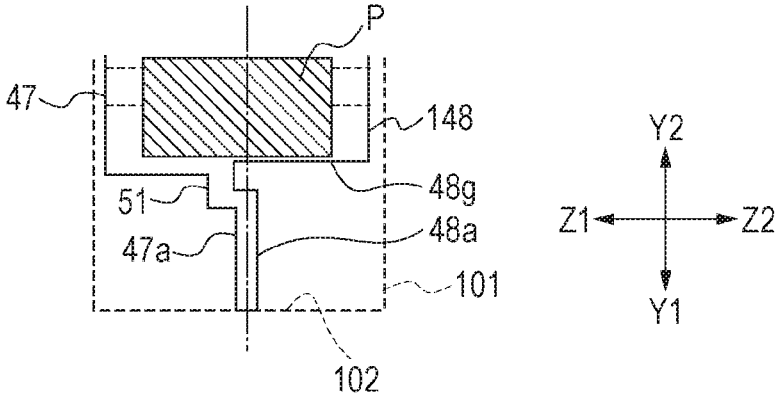
FIG. 15B is a schematic cross-sectional view illustrating a packing member according to another modification of the third embodiment.

In the third embodiment, the load N of the cartridge P is applied to both of the frame member 47 and the lid 48. Alternatively, the load N of the cartridge P may be applied to only one of the frame member 47 and the lid 48. For example, as shown in FIGS. 15A and 15B, given that a direction along the joined surface 46*a* is a vertical direction, the first recessed portion 47*b* of the frame member 47 and the second recessed portion 48*b* of the lid 48 located below the cartridge P in the vertical direction may differ in height. FIG. 15A shows a configuration in which a force receiving portion 47*g* that receives the load N of the cartridge P is provided at the first recessed portion 47*b* of the frame member 47. FIG. 15B shows a configuration in which a force receiving portion 48*g* that receives the load N of the cartridge P is provided at the second recessed portion 48*b* of the lid 48.

Given that a direction along the joined surface 46*a* is a vertical direction, a framework-member-side force receiving portion 47*g* protruding to above the lid 48 in the vertical direction from the frame member 47 toward the lid 48 may be provided, so that only the frame member 47 conies into contact with the cartridge P, as shown in FIGS. 16A to 16C and FIGS. 17A to 17C. A separate description of the configuration including the framework-member-side force receiving portion 47*g* will be made for each position of the supporting portion S to which the load N is applied.

Position where Frame Member and Lid Do not Overlap

Figure 16A:
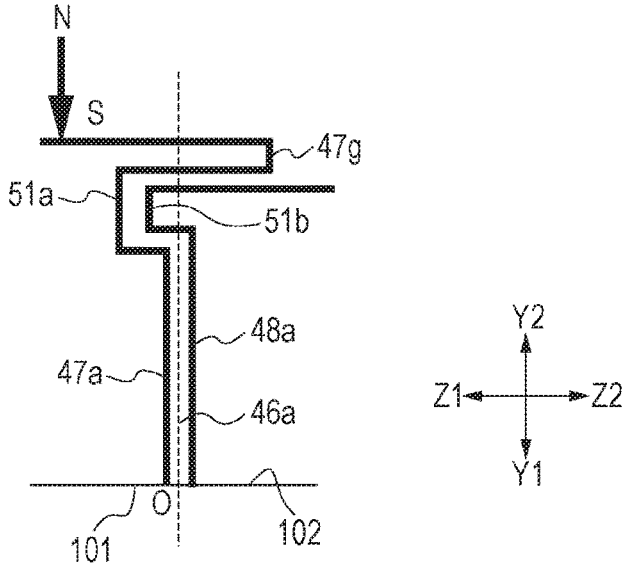
FIG. 16A is a partially enlarged view of a packing member according to a modification of the third embodiment.
Figure 16B:
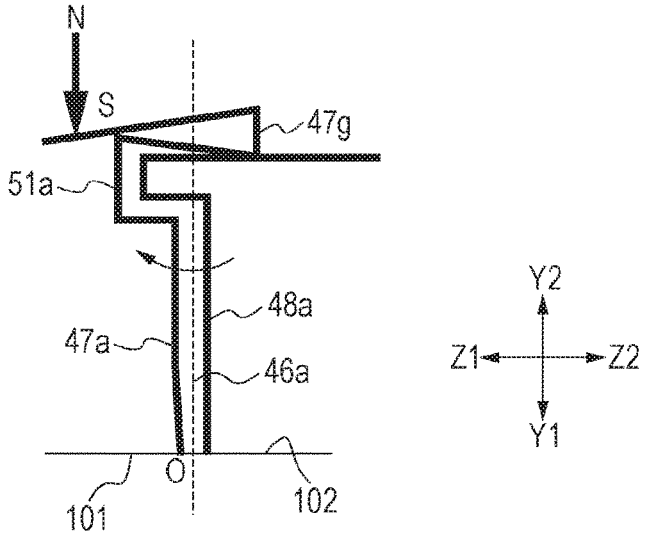
FIG. 16B is a partially enlarged view of the packing member according to the modification of the third embodiment.
Figure 16C:
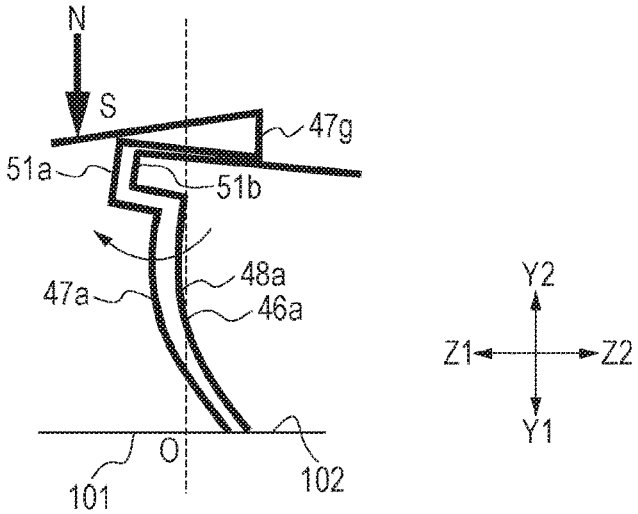
FIG. 16C is a partially enlarged view of the packing member according to the modification of the third embodiment.

Referring to FIGS. 16A to 16C, a description is made for a case where load N is applied to a position where the frame member 47 and the lid 48 do not overlap in the vertical direction. In this case, the frictional force at the portion of contact between the frame member flange 47*a* and the inside wall surface 102 of the box 101 can be small, allowing the frame member flange 47*a* to be well slid from the contact position O relative to the box 101.

Position where Frame Member and Lid Overlap

Figure 17A:
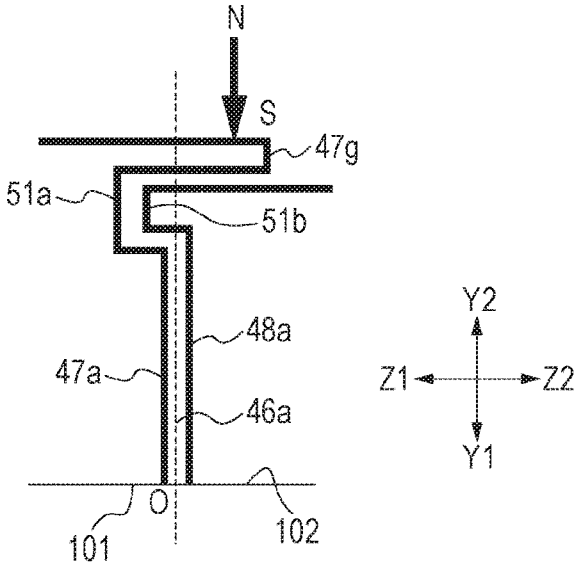
FIG. 17A is a partially enlarged view of a packing member according to a modification of the third embodiment.
Figure 17B:
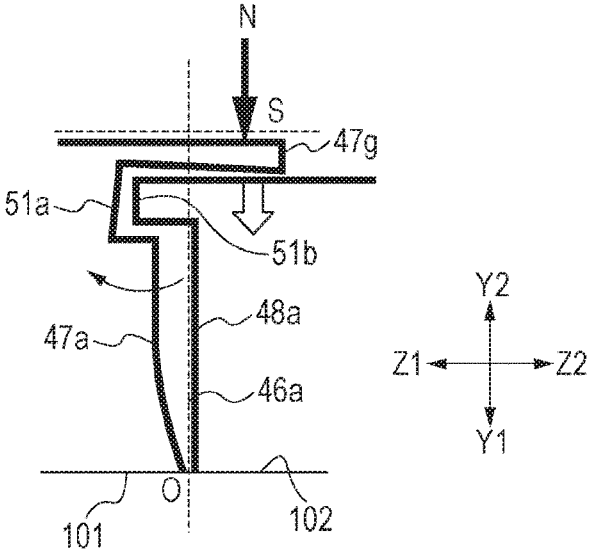
FIG. 17B is a partially enlarged view of the packing member according to the modification of the third embodiment.
Figure 17C:
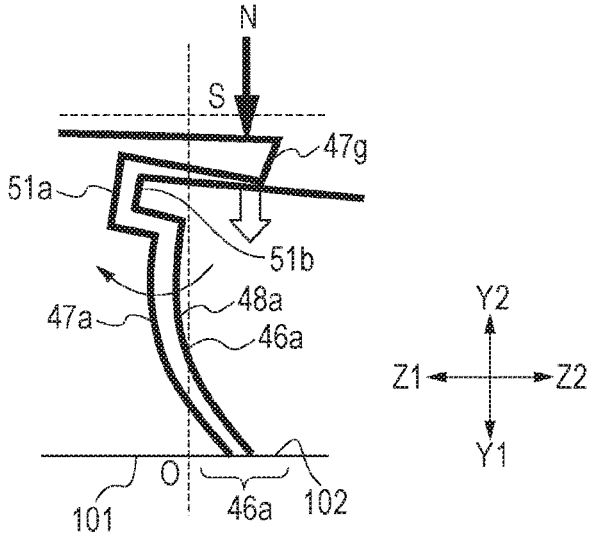
FIG. 17C is a partially enlarged view of the packing member according to the modification of the third embodiment.

Referring to FIGS. 17A to 17C, a description is made for a case where load N is applied to a position where the frame member 47 and the lid 48 overlap in the vertical direction. In this case, the load N received by the framework-member-side force receiving portion 47*g* is indirectly transmitted to the lid 48 because the frame member 47 is deformed (in the direction of arrow in FIGS. 17B and 17C). This can reduce the frictional force at the portion of contact between the lid flange 48*a* and the inside wall surface 102 of the box 101, allowing the lid flange 48*a* to be slid well from the contact position O relative to the box 101, as in the first embodiment.

The asymmetrical configuration of the bent portions of the frame member 47 and the lid 48 causes a good rotational moment, allowing the lid flange 48*a* or the frame member flange 47*a* to be slid from the portion of contact with the inside wall surface 102 of the box 101 in a predetermined direction. Although this embodiment includes the framework-member-side force receiving portion 47*g* protruding from the frame member 47 toward the lid 48, a lid-side force receiving portion protruding from the lid 48 toward the frame member 47 may be provided. This configuration also offers the same advantageous effect as that of this modification.

Other Configurations

Figure 18A:
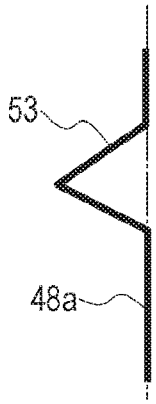
FIG. 18A is a partially enlarged view of a bent portion according to a modification.
Figure 18B:
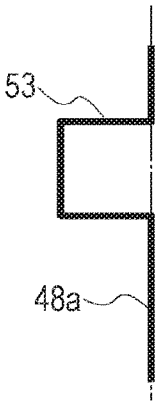
FIG. 18B is a partially enlarged view of a bent portion according to another modification.
Figure 18C:
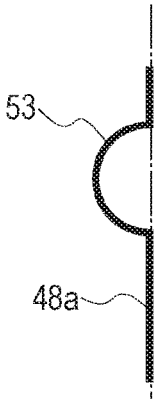
FIG. 18C is a partially enlarged view of a bent portion according to a still another modification.
Figure 19:
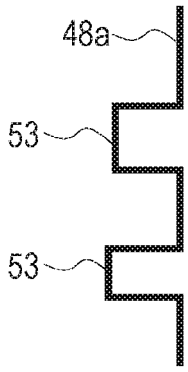
FIG. 19 is a partially enlarged view of a bent portion according to a modification.

Although the first embodiment has its bent portion 52 along the portion of connection between the second flange 48*a* and the second recessed portion 48*b*, and the other embodiments described above have the same configuration, the present invention is not limited to the configuration. For example, a bent portion may be disposed in an intermediate point of the flange 48*a*. Although the bent portions are rectangular in shape, the present invention is not limited to the shape, as shown in FIGS. 18A to 18C, for example, a bent portion 53 (FIG. 18A) having a cross-sectional shape in which two straight lines connect at an intersection (a triangular shape), a bent portion 53 (FIG. 18B) having a cross-sectional shape in which a plurality of straight lines connect at intersections (a polygonal shape), and a bent portion 53 (FIG. 18C) having a curved cross-sectional shape (a semicircular shape). The number of bent portions is not limited to one; a plurality of bent portions may be provided, as shown in FIG. 19.

The first flange 47*a* of the frame member 47 and the second flange 48*a* of the lid 48 are may be integrated. For this purpose, the joined portion may be formed by, in addition to the thermal fusion, as in the above embodiments, physically joining the first flange 47*a* of the frame member 47 and the second flange 48*a* of the lid 48 with an adhesive, a double-faced tape, a hook, or the like. Alternatively, the first flange 47*a* of the frame member 47 and the second flange 48*a* of the lid 48 may be integrally formed. For this purpose, a flange may be provided between the hinge 49 and the first recessed portion 47*b* and the second recessed portion 48*b* in FIG. 2, at which a bent portion may be provided.

Furthermore, the packing member 46 in a state in which the cartridge P is packed, with the lid 48 placed at the top and the frame member 47 at the bottom, is configured such that the distance from an upper end to the first flange 47*a* of the frame member 47 and the distance from a lower end to the second flange 48*a* of the lid 48 are substantially equal. In other words, the depth of the first recessed portion 47*b* of the frame member 47 and the depth of the second recessed portion 48*b* of the lid 48 are substantially equal. However, the present invention is not limited to this configuration and may be changed as appropriate; the configuration may be changed, for example, depending on the position of the center of gravity of the cartridge P.

Furthermore, at least one of the first flange 47*a* and the second flange 48*a* or the hinge 49 may have a gap so that the user can easily unpack the cartridge P from the packing member 46. In general, the gap is provided on this side to make it easy for the user to open the packing member 46. For this reason, the cartridge P may be disposed in the packing member 46 so as to prevent the photosensitive drums 4 from being exposed from the opening of the packing member 46, thereby preventing the user from touching the photosensitive drums 4 by mistake when the user unpacks the packing member 46, with the gap on this side. Furthermore, for the cartridge P having the holding portion 45 for taking out the cartridge P, the cartridge P may be disposed in the packing member 46 so that the holding portion 45 can be accessed through the opening of the packing member 46. This makes it easy to take out the cartridge P from the packing member 46, improving the usability.

Method for Evaluating Impact on Packing Member

In impact during transportation of a packing member 46 according to an embodiment of the present invention can be evaluated by a drop test conforming to JIS-Z-0202. In this example, the evaluation was performed under the condition that the cartridge P is given an impact when dropped from a height of 95 cm to different surfaces. There are two methods of testing described in JIS-Z-0202: a drop test using a free drop testing machine and a drop test using an impact testing machine. The drop test method using the impact testing machine was employed to evaluate impacts corresponding to a drop of 95 cm on cartridges P packed in the packing members 46 according to the above embodiments, The results showed that the packing members according to the embodiments have sufficient impact absorbing and cushioning performance. In determining the position of the supporting portion S that receives a load on the packing members 46, the load is applied, with a pressure measuring film interposed between each packing member 46 and the cartridge P, to allow a location on which the load is applied to be visually recognized.

While the present invention has been described with reference to exemplary embodiments, it is to be understood that the invention is not limited to the disclosed exemplary embodiments, The scope of the following claims is to be accorded the broadest interpretation so as to encompass all such modifications and equivalent structures and functions.

This application claims the benefit of Japanese Patent Application No. 2014-201849, filed Sep. 30, 2014, which is hereby incorporated by reference herein in its entirety.

The invention claimed is:

1. A packing member for packing a cartridge, the cartridge being attachable to and detachable from an image forming apparatus, the packing member comprising:

a first member provided with a first recessed portion and including a first flange connected to the first recessed portion, the first flange including a first bent portion; and a second member provided with a second recessed portion and including a second flange connected to the second recessed portion, the second flange including a second bent portion, the second member being connected to the first member with a connecting portion, and the first flange and the second flange being overlapped and welded to form a joined surface such that a space for accommodating the cartridge is formed by the first recessed portion and the second recessed portion, wherein in a direction intersecting the joined surface, the first bent portion and the second bent portion protrude with respect to the joined surface in a first direction from the first member toward the second member, and the second bent portion protrudes with respect to the joined surface in the first direction, and wherein in a direction along the joined surface, the first bent portion and the second bent portion are disposed on an opposite side of the connecting portion with respect to the first recessed portion and the second recessed portion.

2. The packing member according to claim 1, wherein in the direction along the joined surface, the first bent portion is disposed on an inner side with respect to an outer end of the first flange, and the second bent portion is disposed on an inner side with respect to an outer end of the second flange.

3. The packing member according to claim 1, wherein the first flange includes a plurality of the first bent portions.

4. The packing member according to claim 1, wherein the first recessed portion includes a first force receiving portion configured to receive a load from the cartridge by contacting the cartridge.

5. The packing member according to claim 1, wherein the second flange includes a plurality of the second bent portions.

6. The packing member according to claim 1, wherein the second recessed portion includes a second force receiving portion configured to receive a load from the cartridge by contacting the cartridge.

7. The packing member according to claim 4, wherein the first force receiving portion protrudes toward the second recessed portion with respect to the joined surface in a direction perpendicular to the joined surface.

8. The packing member according to claim 1, wherein the first recessed portion, the second recessed portion, the first flange, and the second flange are integrally formed.

9. The packing member according to claim 8, wherein the packing member is made of resin formed with vacuum pressure forming.

10. The packing member according to claim 1, wherein the first flange, the second flange, and the connecting portion are extended in a longitudinal direction of the cartridge.

11. The packing member according to claim 1, wherein the first bent portion includes a first surface, a second surface, and a first corner formed by the first surface and the second surface, wherein the second bent portion includes a third surface, a fourth surface, and a second corner formed by the third surface and the fourth surface, wherein the first surface and the third surface extend to the direction intersecting the joined surface, and the second surface and the fourth surface extend to the direction along the joined surface.

12. A packing member for packing a cartridge, the cartridge being attachable to and detachable from an image forming apparatus, the packing member comprising:

a first member provided with a first recessed portion, and including a first flange connected to the first recessed portion; and a second member provided with a second recessed portion, and including a second flange connected to the second recessed portion, the first flange and the second flange being overlapped and welded to form a joined surface such that a space for accommodating the cartridge is formed by the first recessed portion and the second recessed portion, wherein the first recessed portion includes a first force receiving portion, the force receiving portion including a first force receiving surface, the first force receiving surface configured to receive a load from the cartridge by contacting the cartridge, and wherein the first force receiving portion is extended toward the second member from the first member so that at least part of the first force receiving portion protrudes with respect to the joined surface in the direction perpendicular to the joined surface.

13. The packing member according to claim 12, wherein the first recessed portion, the second recessed portion, the first flange, and the second flange are integrally formed.

14. The packing member according to claim 13, wherein the packing member is made of resin formed with vacuum pressure forming.

15. The packing member according to claim 12, wherein the first flange and the second flange are extended in a longitudinal direction of the cartridge.

16. The packing member according to claim 12, wherein in a direction along the joined surface, a gap is formed between and the first force receiving portion and the second member.

17. The packing member according to claim 16, wherein the first force receiving portion is able to come into contact with a second member by being deformed.

18. The packing member according to claim 12, wherein the first force receiving surface is configured to contact the cartridge at a position away from the joined surface in the direction perpendicular to the joined surface.

* * * * *